United States Patent [19]

Maenishi et al.

[11] Patent Number: 4,734,669

[45] Date of Patent: Mar. 29, 1988

[54] ELECTROMAGNETIC CONTACTOR

[75] Inventors: Kozo Maenishi, Nagaokakyo; Takashi Tanaka, Takatsuki; Haruo Ogata, Nagaokakyo; Youichi Nakanishi, Kyoto; Kenichi Tsuruyoshi, Kusatsu, all of Japan

[73] Assignee: Omron Tateisi Electronics Co., Kyoto, Japan

[21] Appl. No.: 898,520

[22] Filed: Aug. 21, 1986

[30] Foreign Application Priority Data

| | | | |
|---|---|---|---|
| Aug. 23, 1985 | [JP] | Japan | 60-186145 |
| Aug. 30, 1985 | [JP] | Japan | 60-133937[U] |
| Sep. 4, 1985 | [JP] | Japan | 60-136145[U] |
| Sep. 10, 1985 | [JP] | Japan | 60-201125 |
| Sep. 18, 1985 | [JP] | Japan | 60-207495 |
| Sep. 19, 1985 | [JP] | Japan | 60-207891 |

[51] Int. Cl.[4] ..... H01H 67/02

[52] U.S. Cl. ..... 335/132; 335/202

[58] Field of Search ..... 335/132, 202, 131, 161, 335/126, 197, 188, 198, 273, 4, 258, 133

[56] References Cited

U.S. PATENT DOCUMENTS

| | | | |
|---|---|---|---|
| 4,378,542 | 3/1983 | Feil | 335/132 |
| 4,509,026 | 4/1985 | Matsushita | 335/132 |

*Primary Examiner*—E. A. Goldberg

*Assistant Examiner*—Lincoln Donovan

*Attorney, Agent, or Firm*—Wegner & Bretschneider

[57] ABSTRACT

An electromagnetic contactor according to the present invention is so constructed that the electromagnetic device and the fixed point of contact are fixedly fitted into a casing which is divisible in the direction along the moving direction of a polar contact. Moreover, a bottom casing with a screw mounting hole is fitted in the outer peripheral portion at the lower end of the casing. Therefore, the rigidity of the casing as a whole is enhanced, and at the same time the working characteristics can be prevented from being changed when the screw is mounted. Furthermore, the positioning accuracy of the electromagnetic device relative to the fixed point of contact is determined only by the dimensional accuracy of the casing and the electromagnetic device, and by the position accuracy of the fixed point of contact. The contact pressure is improved to be stable.

34 Claims, 26 Drawing Figures

| Fig. 7(a) | Fig. 7(b) |
|---|---|

ELECTROMAGNETIC CONTACTOR

BACKGROUND OF THE INVENTION

The present invention generally relates to an electromagnetic contactor and more particularly, to a structure for fixing an electromagnetic device and a fixed point of contact within the electromagnetic contactor.

Generally, an electromagnetic contactor opens and/or closes a fixed point of contact by a movable insulative stand having a moving point of contact through a polar contact reciprocating in accordance with the excitation or de-magnetization of an electromagnetic device. Such electromagnetic contactor as referred to above is disclosed, for example, in the published specification of Japanese Patent application Laid-open Publication (unexamined) No. Tokkaisho 58-209837 (209837/1983). More specifically, in the electromagnetic contactor disclosed in this Publication No. Tokkaisho 58-209837, the fixed point of contact and the electromagnetic device are individually secured respectively to an upper casing and a lower casing which is a separate body from the upper casing. The upper casing and the lower casing have their respective faces orthogonal to a moving direction of the polar contact joined with each other so that both casings are formed into one unit in a vertical direction.

However, because of this united structure of the upper and lower casings in the vertical direction, the electromagnetic contactor is disadvantageously apt to have high possibilities for dimensional errors in the vertical direction, that is, in the moving direction of the polar contact. Therefore, the prior art electromagnetic contactor cannot get rid of a low relative positioning accuracy between internal components. It is also a problem to be solved that the contact pressure, that is, the pressure applied to a point of contact is not constant, rather is variable.

Also, in the electromagnetic contactor of the type disclosed in the Publication No. Tokkaisho 58-209837, a movable iron core (armature 7) constituting the polar contact is inserted through into a central hole (hole 17) of a spool (hoisting drum 16) so as to be able to reciprocate, which consequently restricts the position of the polar contact in the direction of the reciprocal movement.

Since the spool is thin, however, it is easily affected and deformed by contraction force at the time of molding, winding force when the coil is wound around the spool, heat stress resulting from generation of heat accompanied by application of voltage to the coil, or external force added during the operation of the electromagnetic contactor, etc. Therefore, the axial center of the movable iron core comes away from a predetermined position in the electromagnetic contactor, and the contacts are poorly overlapped with each other. Thus, the prior art electromagnetic contactor is unstable in opening-closing efficiency.

Furthermore, since the spool has a short diameter of the center hole, the reciprocal movement of the movable iron core which is restricted in position by the central hole of the spool is unreliably stable, and therefore the movable iron core is apt to waver resulting in that the contact pressure does not become constant, and the bouncing time is prolonged.

SUMMARY OF THE INVENTION

Accordingly, an essential object of the present invention is to provide an electromagnetic contactor in which an electromagnetic device and a fixed point of contact are fixed fitted into a casing which is separable in the moving direction of a polar contact, while substantially eliminating the above-described disadvantages inherent in the prior art electromagnetic contactors.

According to the present invention, the relative positioning accuracy of the electromagnetic device to the fixed point of contact is determined only by the dimensional accuracy of the casing and the electromagnetic device, and the positioning accuracy of the fixed point of contact. Therefore, the dimensional error in the vertical direction which would be given rise to in the prior art contactor having the upper casing formed into one unit with the lower casing does not be produced. As a result, the electromagnetic contactor of the present invention can display such effects that the relative positioning accuracy between the internal components in the vertical direction is not damaged, and the contact pressure can be stably maintained with little change.

Another object of the present invention is to provide an electromagnetic contact of the type referred to above which has an ajdustment aperture for an adjusting means for working characteristics provided in a wall of the casing orthogonal to the axial center of a reciprocating movable iron core, said adjustment aperture being covered with a detachable covering.

According to the present invention, the adjusting member of working characteristics of a fixed point of contact, which member is adjustable from outside, can be adjusted from the adjustment aperture formed in the wall of the casing. Therefore, even after the inner components like the electromagnetic device, etc. are assembled into the casing which is then formed into one unit, the working characteristics can be adjusted without disassembling the casing. Even in the case that the working characteristics inspected after the assembly of the casing are out of the provisions, the working characteristics can be adjusted by the adjusting means through the adjustment aperture without disassembling the casing. Accordingly, the adjustment of the working characteristics can be simply carried out with no trouble.

A further object of the present invention is to provide an electromagnetic contactor of the type referred to above which is provided with a casing for accommodating inner components therein, said casing being divisible in the lateral direction, and being fixedly fitted with a bottom casing in the outer peripheral portion at the lower end thereof.

In accordance with the present invention, since the casing for accommodating the inner components is constructed in a separate body from the bottom casing which has a mounting hole for the screw and is fixedly fitted in the outer peripheral portion at the lower end of the casing, the tightening force when the screw is mounted does not directly influence the casing which accommodates the internal components. Therefore, the working characteristics are less damaged by the deformation of the casing than in the prior art. In addition, the bottom casing is fixedly fitted into the outer peripheral portion at the lower end of the divisible casing, and accordingly, the casing as a whole becomes high in rigidity.

Yet another object of the present invention is to provide an electromagnetic contactor of the type referred to above which has a polar contact integrally formed with a movable insulative stand, with a spring member being installed in an electromagnetic device so that the matching between the suction force characteristics and the load of the electromagnetic device can be adjusted.

A still further object of the present invention is to provide an electromagnetic contactor of the type referred to above in which the spring member for applying a restoring force to the polar contact and the movable insulative stand is divided into two spring materials, one of which has an adjustable spring force.

Another object of the present invention is to provide an electromagnetic contactor of the type referred to above which has the matching spring held between a yoke constituting the electromagnetic device and a bearing which is fittingly pressed into a bearing hole formed in the yoke for supporting one end of the polar contact.

Accordingly, the matching spring is directly held between the yoke and the bearing which therefore function for securing the spring. Thus, no special element is needed for securing the spring, resulting in reduction of the number of components. Moreover, since the positioning accuracy and the working characteristics of the spring means are determined only by the internal components, the spring member is prevented from bad influences upon the positioning accuracy and the working characteristics which would be brought above when they are determined by housing materials. In addition to the above, since the working characteristics can be inspected and adjusted while the housing is not put in place, the electromagnetic contactor can be assembled with much ease.

A further object of the present invention is to provide an electromagnetic contactor of the type referred to above which includes the coil spring intervened between the movable insulative stand and the yoke and, a projection with an engaging portion at the lateral side thereof provided in a part of the movable insulative stand opposite to the yoke, so that one end of the coil spring is engaged with the projection.

Yet another object of the present invention is to provide an electromagnetic contactor of the type referred to above which has a movable iron core supported in such a manner as to be able to reciprocate by opposing bearing hole formed in a frame-like yoke surrounding the spool of the electromagnetic device. Therefore, in the above-described construction, the slippage of the axial center of the movable iron core by the deformation of the spool can be prevented since the movable iron core is supported by the bearing hole in such a manner as to be able to reciprocated. In consequence to this, the contacts can be overlapped well, and the opening-closing efficiency of the contactor can be stabilized. Because of the construction that the frame-like yoke surrounds the spool, the movable iron core is supported by the bearing hole of the yoke having a larger diameter than the central hole of the spool in such a manner as to be able to reciprocate. Accordingly, the movable iron core wavers less and the contact pressure can be stabilized, and at the same time, the bouncing time is advantageously reduced.

A still further object of the present invention is to provide an electromagnetic contactor of the type referred to above in which opposite lateral sides of a movable iron piece constituting the polar contact are embraced by a pair of embracing members provided at the opposite sides of the movable insulation stand.

Accordingly, the polar contact and the movable insulation stand can be directly coupled to each other, without the provision of any separately provided coupling means, in the electromagnetic contactor of the present invention. As a result not only can the number of components be reduced as compared with the prior art contactor, but also the the height of the electromagnetic contactor itself becomes lower. Moreover, since the polar contact and the movable insulation stand are coupled to each other without the provision of any coupling means, possibilities of errors in mounting can be reduced. Accordingly, the positioning accuracy of thepolar contact relative to the movable point of contact provided in the movable insulation stand is enhanced, resulting in such advantage that the contact pressure between the movable point of contact and the fixed point of contact in the casing is effective turned near to be constant.

Another object of the present invention is to provide an electromagnetic contactor of the type referred to above in which the movable insulation stand and the polar contact are coupled to each other in such a manner as to be slidable in a direction orthogonal to the moving direction of the polar contact.

Because of this structure, the movable insulation stand and the polar contact can be slid in the direction orthogonal to the direction of the reciprocal movement of the polar contact, and thus the positional adjustment of the movable insulation stand relative to the polar contact is rendered possible. Moreover, the movable insulation stand and the polar contact can be positioned with high accuracy in the direction orthogonal to the direction of the reciprocation of the polar contact. Accordingly, it becomes possible for the movable insulation stand and the polar contact to reciprocate, respectively, maintaining minimum clearance from the insulative wall of the casing and the spool of the electromagnetic device, etc. The high positioning accuracy of the movable insulation stand relative to the polar contact achieved by the present invention can reduce the frictional resistance, stabilizing the working characteristics. Because the clearance can be minimum, there is no necessity for a large air gap to be prepared, and accordingly the electromagnetic contactor can be made smaller in size.

A further object of the present invention is to provide an electromagnetic contactor of the type referred to above in which a leading wire of the coil taken out from the spool along a pair of arm positions extending over the yoke from an armor portion of the spool surrounded by the yoke is electrically connected to a relay terminal arranged in a holder part connecting ends of the arm portions. Thus, the connecting operation of the leading wire becomes easy. Additionally, owing to the fact that a pair of the arm portions are extended form the armor portion of the yoke in such a manner as to step over the yoke, the leading wire of the coil can be drawn out of the spool simply without being entangled or short-circuited. Furthermore, the mechanical strength of the internal components is increased since the ends of a pair of the arm positions are connected to each other by the holder portion of the relay terminal.

Yet another object of the present invention is to provide an electromagnetic contactor of the type referred to above in which the leading wire of the coil is electrically connected to the coil terminal through soldering to a projection which projects out of the relay terminal.

In accordance with this structure, the leading wire of the coil can be electrically connected to the coil terminal with much ease. Particularly, if the projection protruding out of the relay terminal is a leading wire of an electric component fixedly pressed into the relay terminal, all of the leading wire of the coil, the relay terminal and the electric components can be soldered simultaneously at one time for electric connection, thereby to further improve the working efficiency in electric connection.

A still further object of the present invention is to provide an electromagnetic contactor of the type referred to above which is mounted in such a construction that a guiding part having an engaging portion to be engaged with one side of a rail is formed at the one end of the bottom surface of the electromagnetic contactor, and an elastic engaging means having an engaging claw to be engaged with the other side of the rail is fixed at its opposite ends to the bottom surface of the electromagnetic contactor with the same interval from the guiding part as the rail width, the central portion of which is coupled to a backwardly curved coupling means, said engaging claw protruding inwardly in the vicinity of the coupling means.

Another object of the present invention is to provide an electromagnetic contactor of the type referred to above which has a terminal covering installed in such a manner that a projection is formed in either the inner surface at the outer side of a terminal receiver at the opposite ends among terminal receivers or the lateral side surface of a terminal protecting part opposed to the side surface of the terminal receiver, with a recess to be engaged with the projection being formed in the other one of the inner surface or the lateral side surface.

A further object of the present invention is to provide an auxiliary contact system of an electromagnetic contactor comprising an auxiliary casing mounted on the body of the electromagnetic contactor, a movable contact piece made of elastic material which has one end secured to a terminal fixed to the auxiliary casing, and an auxiliary point of contact provided at the intermediate portion thereof, a fixed terminal secured to the auxiliary casing and having an auxiliary fixed point of contact opposed to the auxiliary movable point of contact and an insulative card to which is engaged a free end of the movable contact piece and which is integrally formed with the movable insulation stand installed in the body of the electromagnetic contactor so as to reciprocate to open or close the auxiliary point of contact.

A still further object of the present invention is to provide an electromagnetic contactor of the type referred to above in which an end portion of a coil terminal composed of contact terminals without a point of contact is pressed into contact with a receiver member of a relay terminal for electric connection.

As described above, since the contact terminal serves as a coil terminal, terminal components can be used in common, thereby reducing the number of components of the electromagnetic contactor.

BRIEF DESCRIPTION OF THE DRAWINGS

These and other objects and features of the present invention will become apparent from the following description taken in conjunction with the preferred embodiments thereof with reference to the accompanying drawings, in which.

DESCRIPTION OF THE PREFERRED EMBODIMENTS

Figure 1:
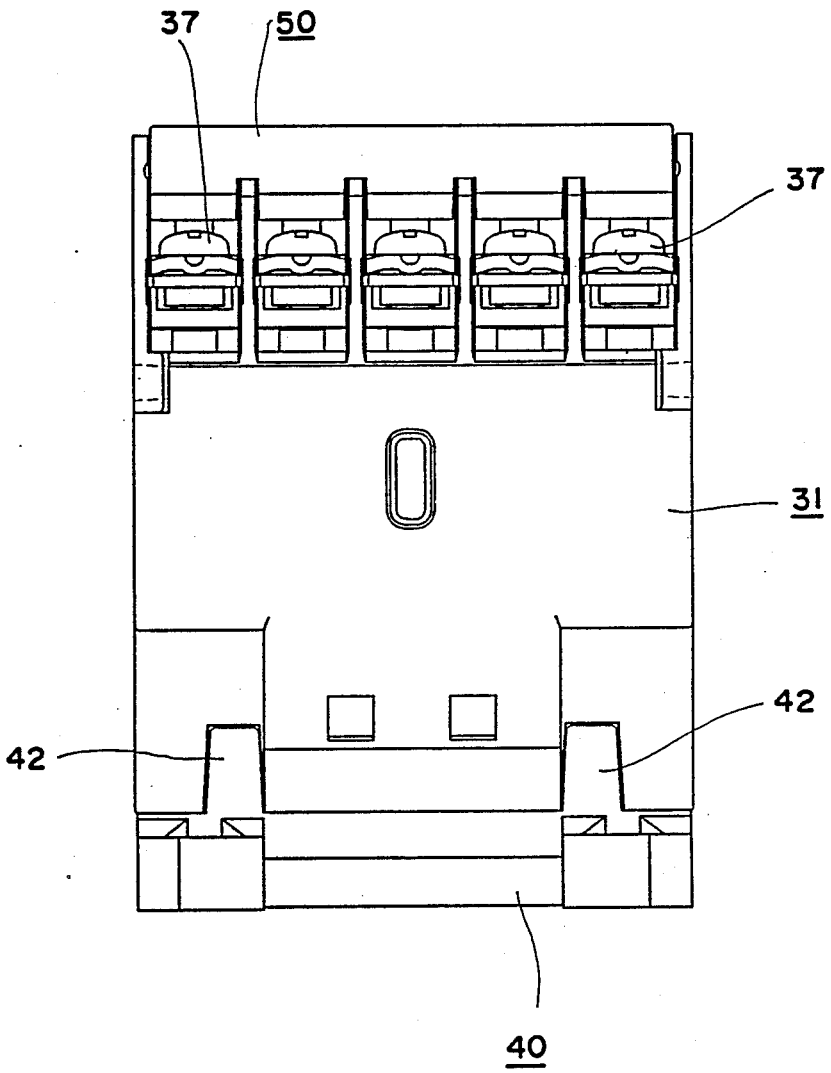
FIG. 1 is a front view of an electromagnetic contactor according to a first embodiment of the present invention.
Figure 2:
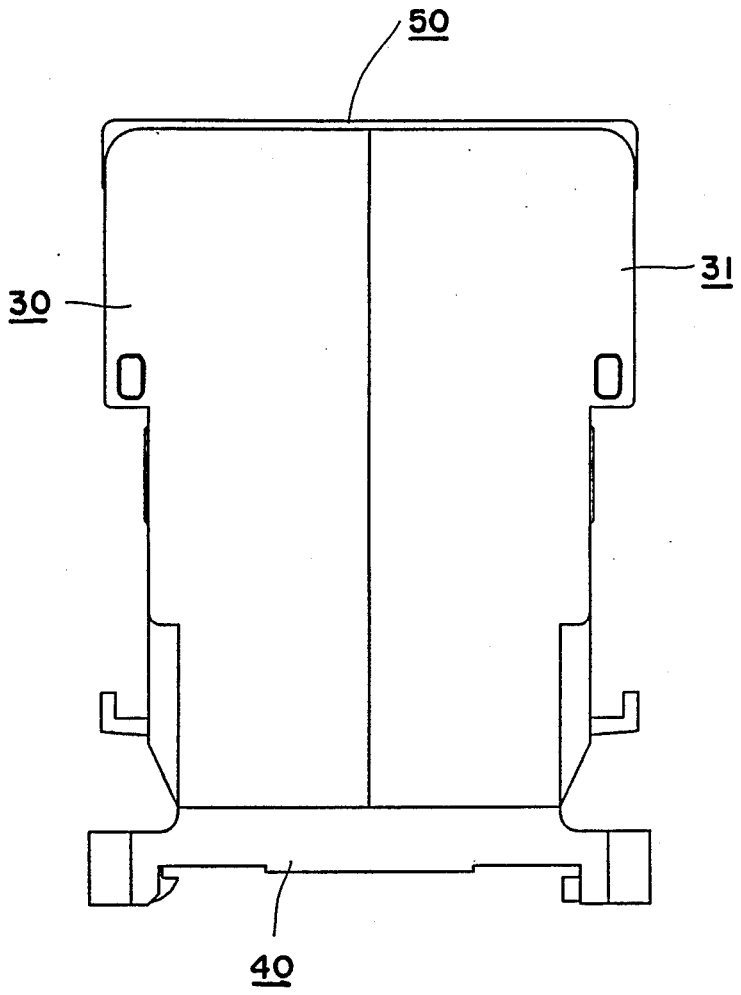
FIG. 2 is a side elevational view of the electromagnetic contactor of FIG. 1.
Figure 3:
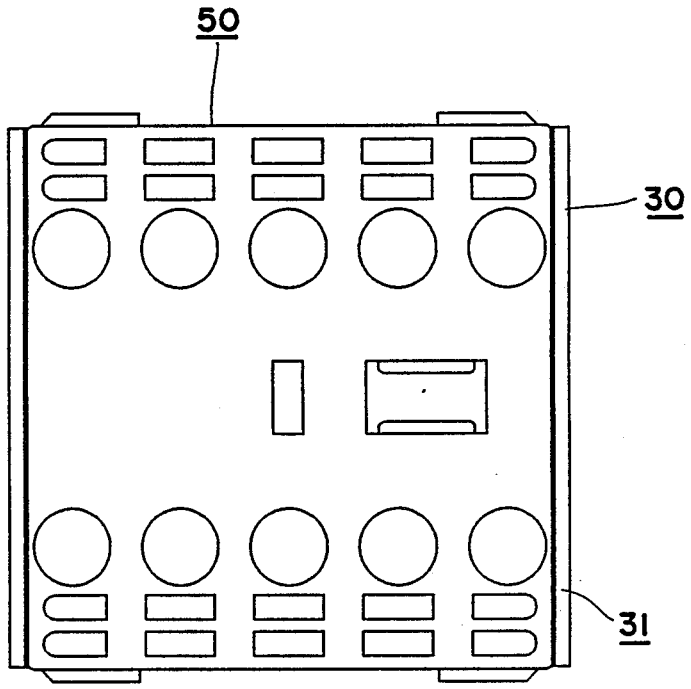
FIG. 3 is a plan view of the electromagnetic contactor of FIG. 1.
Figure 4:
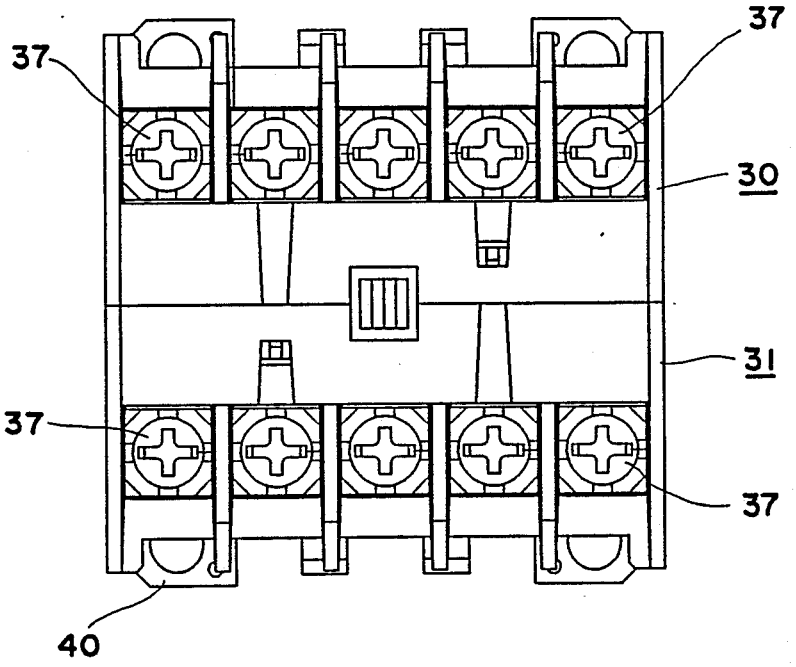
FIG. 4 is a similar view of FIG. 3, but removing a terminal protection covering from the electromagnetic contactor.
Figure 5:
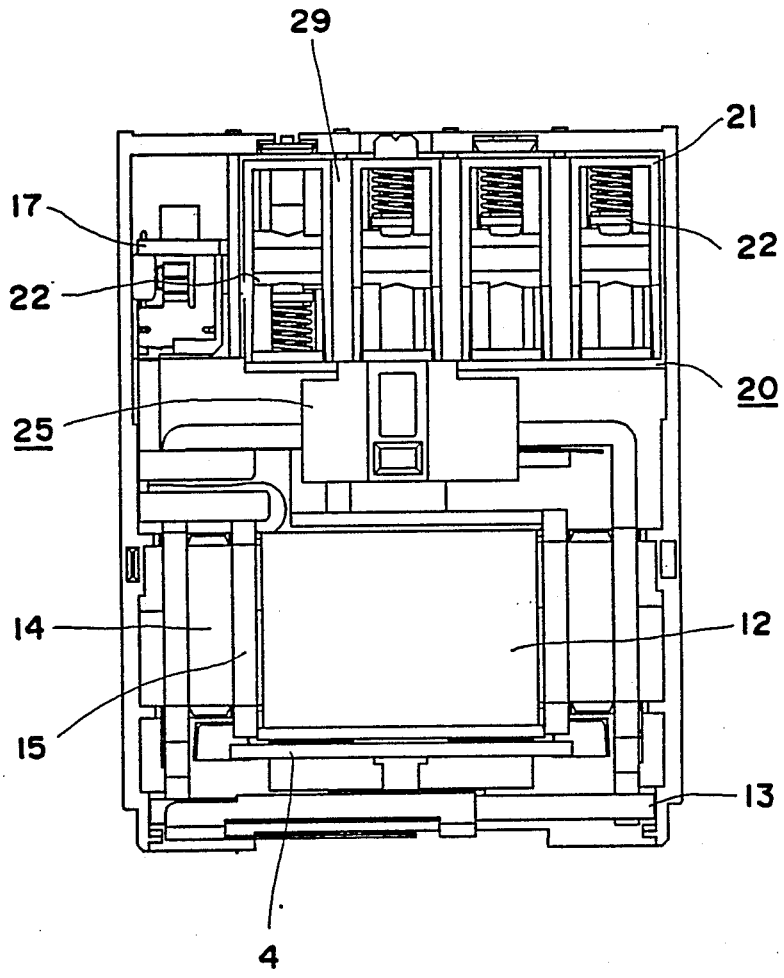
FIG. 5 is a front view of an electromagnetic device and a movable insulation stand installed within a side casing of the electromagnetic contactor of FIG. 1.
Figure 6:
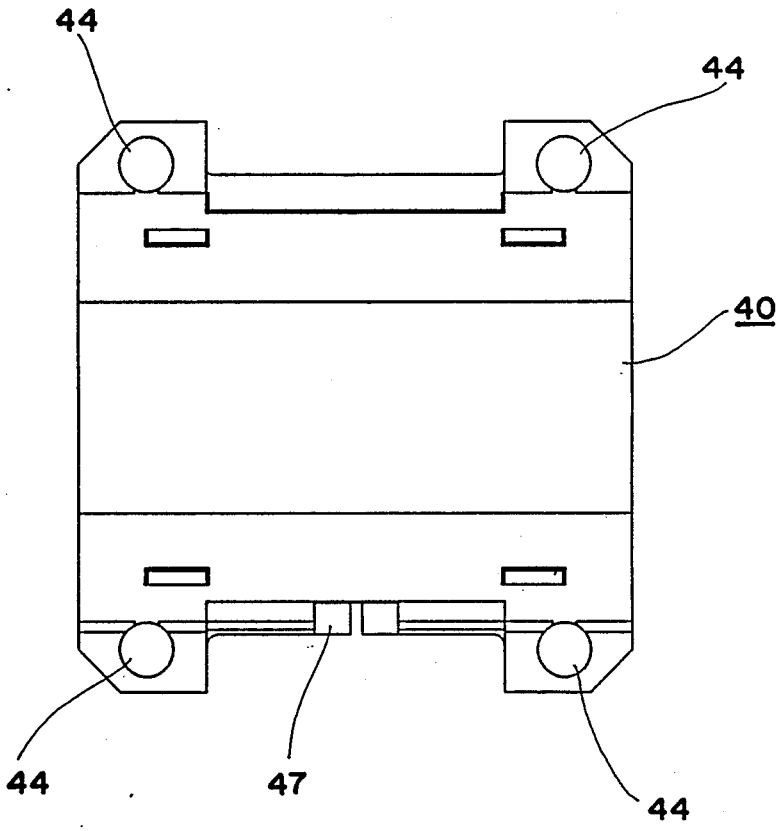
FIG. 6 is a bottom view of a bottom casing of the electromagnetic contactor of FIG. 1.

Before the description of the present invention proceeds, it is to be noted that like parts are designated by like reference numerals throughout the accompanying drawings. Also, it is to be noted that in the accompanying drawings, the upward direction of the embodiments of the present invention is shown with Y', and the downward direction is shown with Y.

FIGS. 1 to 17 show an electromagnetic contactor, according to a first embodiment of the present invention, comprising a polar contact 1, an electromagnetic device 10, a movable insulation stand 20, side casings 30 and 31, a bottom casing 40 and a terminal protection covering 50.

Figure 7A:
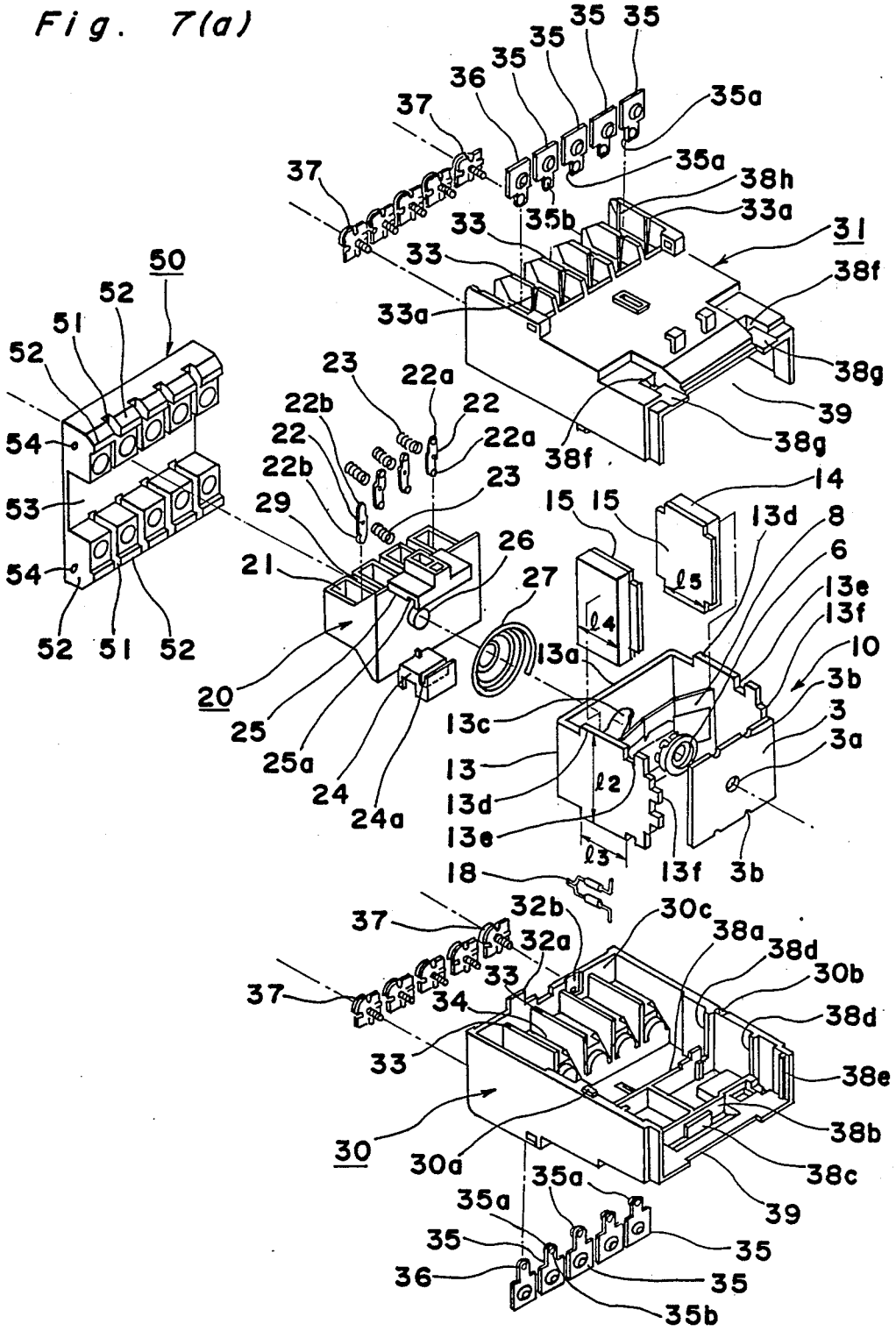
FIGS. 7(*a*) and 7(*b*) are exploded perspective views showing all parts of the electromagnetic contactor of FIG. 1.
Figures 7, 7B:
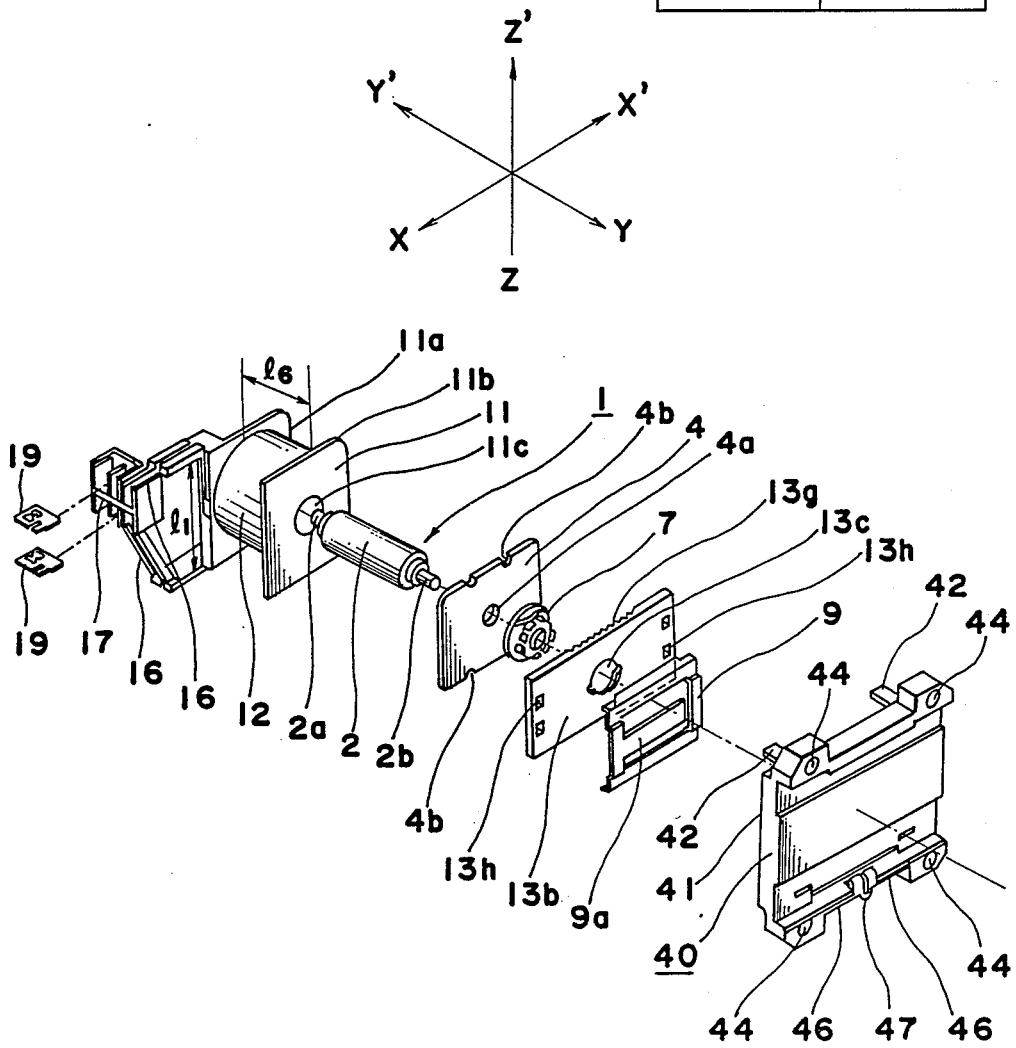
Figure 8:
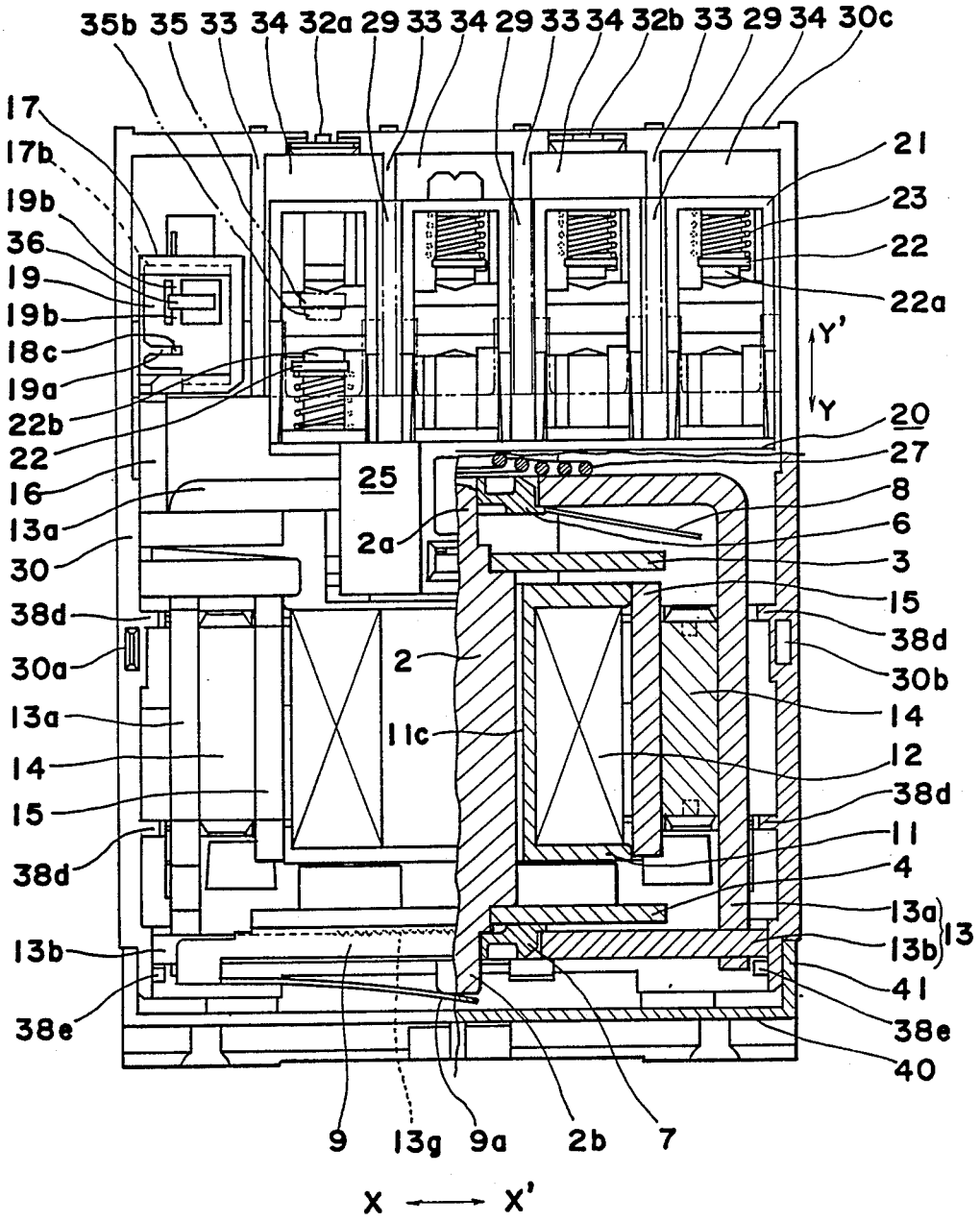
FIG. 8 is a front view, on an enlarged scale, of the electromagnetic contactor of FIG. 1, after removing the front side casing to show the electromagnetic device in a cross-section being partly broken away.

Referring to FIG. 7, the polar contact 1 is comprised of a stepped movable iron core 2 having shaft supporting portions 2a and 2b at the opposite ends thereof and, movable iron pieces 3 and 4 which are fixed to the opposite ends of the movable iron core 2 by projecting the shaft supporting portions 2a and 2b out of holes 3a and 4a. There are positioning notches 3b and 4b formed at the opposite side ends in the longitudinal direction of the movable iron pieces 3 and 4, respectively.

The polar contact 1 is installed into the electromagnetic device 10 through bearings 6 and 7 made of non-magnetic material such as plastics, an operating spring 8 and a sliding adjustment spring 9 having a leaf spring 9a so that the polar contact 1 is able to reciprocate.

Figure 10:
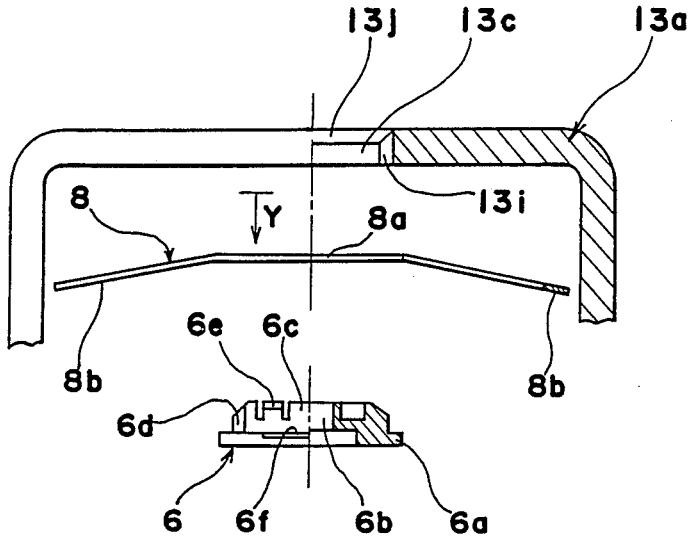
FIG. 10 is a front view, with a partial cross-section, of a bearing and an operational spring of the electromagnetic contactor of FIG. 1.
Figure 11:
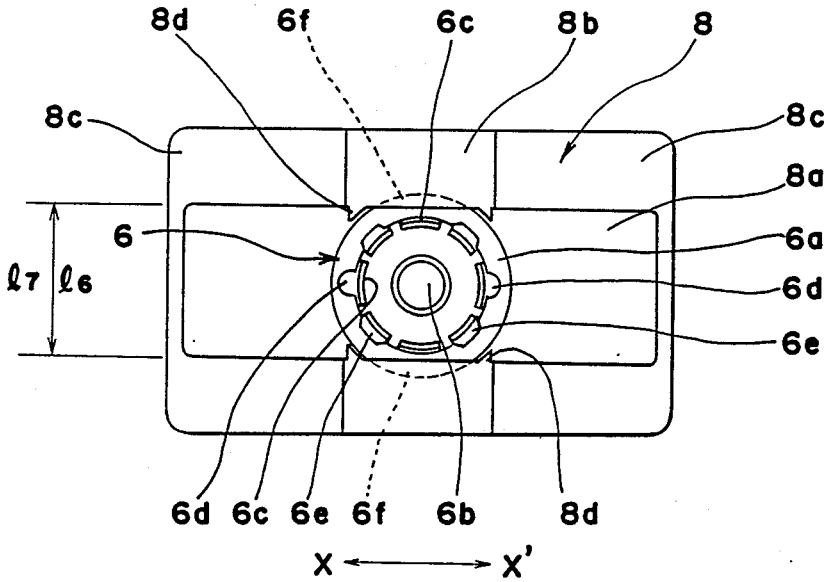
FIG. 11 is a plan view of FIG. 10 as seen from the Y direction thereof.

As shown in FIGS. 10 and 11, the bearing 6 having the same configurations as the bearing 7 is provided with an axial hole 6b at the center of a flange 6a which is a circular configuration around the outer peripheral portion of the bearing, and at the same time, the bearing 6 has a plurality of engagement pieces 6a erected with a predetermined interval between the adjacent ones. The engagement pieces 6c are concentric with the axial hole 6b. A small projection 6d is formed at the outer side surface of each of opposed engagement pieces 6c and 6c so that the projection 6d is engaged with a notched portion 13i formed in a bearing hole 13c of an outer frame yoke 13a to prevent the bearing 6 from loosely rotating. On the other hand, a claw 6e is provided at the upper brim of the outer side surface of the other engagement piece 6c so that the claw 6e is engaged with a chamfered portion 13j formed in the bearing hole 13c to prevent the bearing 6 from slipping off. Further, on the upper surface at the opposite sides of the flange 6a are formed a pair of stepped portions 6f and 6f having the same size of step difference as the thickness of the operating spring 8. The distance between the stepped portions 6f and 6f is a length of l6.

The operational spring 8 is a leaf spring of generally rectangular shape and has a rectangular hole 8a punched out therefrom. The rectangular hole 8a has a width l7 which is the same as the distance l6 between the stepped portions 6f and 6f, which hole 8a is therefore able to be fitted in between the stepped portions 6f and 6f for positioning. In order to control the movement of the leaf spring 8 in the direction of the X-X' axis, an engagement claw 8d is provided at the central part 8b of the spring 8 in such a manner as to protrude into the rectangular hole 8a. The engagement claw 8d has a face formed into such a shape as to be freely fitted into the outer peripheral surface of the flange 6a constituting the bearing 6, with a little clearance from the flange 6a. Moreover, the operational spring 8 has side parts 8c and 8c bent with the same angles to the side of the same direction.

The electromagnetic device 10 is comprised of a spool 11 having flanges 11a and 11b at opposite ends thereof, a coil 12 wound around the drum of the spool 11, an outer frame yoke 13 having a generally square cross section and surrounding the spool 11, permanent magnets 14 and 14 intervened between the outer frame yoke 13 and the spool 11, and inner plate yokes 15 and 15.

Figure 9:
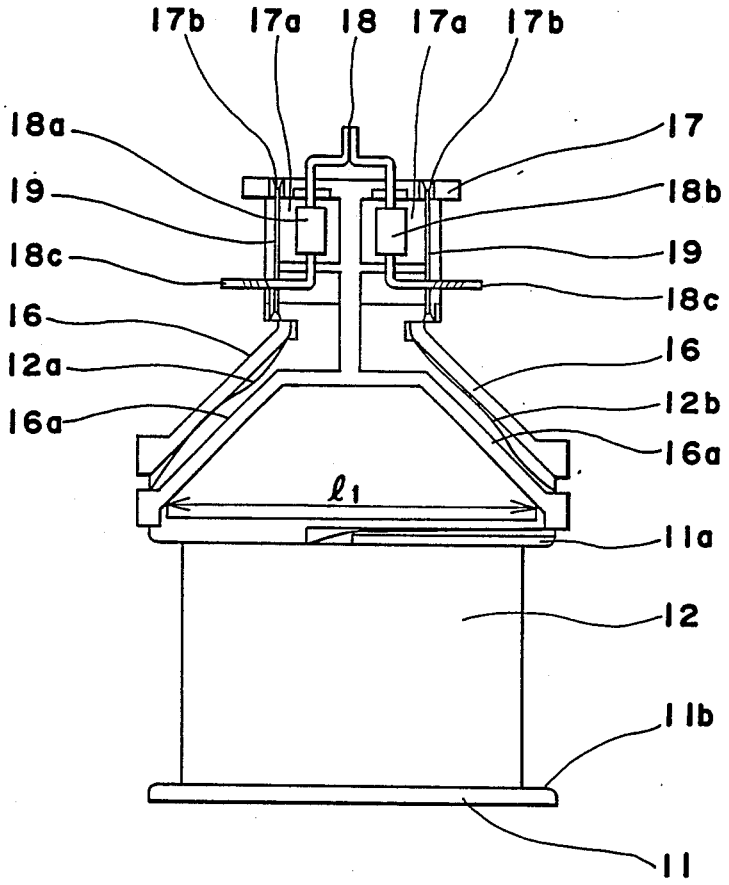
FIG. 9 is a front view of a spool of the electromagnetic contactor of FIG. 1.

Referring to FIG. 9, the spool 11 is formed with a central hole 11c at the drum thereof, within which hole 11c the movable iron core 2 can reciprocate, and at the same time, the spool 11 has a pair of arm portions 16 and 16 extending from a corner of the flange 11a, and a holder member 17 for the relay terminal which connects the ends of the arm portions 16 and 16 with each other.

Guide grooves 6a and 16a are formed in the arm portions 16 and 16 so as to guide the ends 12a and 12b of the coil 12. In the holder member 17, there are formed recesses 17a and 17a which receive a surge absorption element 18 in which a diode 18a and a resistance 18b are connected in series, and also grooves 17b and 17b into which are pressed relay terminals 19 and 19.

The relay terminals 19 and 19 are made by punching out by a press. The relay terminal 19 includes a notched groove 19a into which a leading wire 18c of the surge absorption element 18 is pressed, and a pair of opposed tongue pieces 19b and 19b into which a coil terminal 36 is pressed for electric connection.

The outer frame yoke 13 consists of a yoke 13a bent in a generally ]-shape and a plate-like yoke 13b. The yokes 13a and 13b have bearing holes 13c and 13c respectively formed in the center thereof so that the bearings 6 and 7 are fixedly fitted into the holes 13c and 13c.

Moreover, at the opposite side walls, the bent yoke 13a is formed with projections 13d and 13d for positioning opposed to each other, notched portions 13e and 13e for positioning and protrusions 13f and 13f for fitting. Meanwhile, at the brim of the inner side surface of the plate-like yoke 13b in the longitudinal direction, there are provided a zigzag 13g with small consecutive notches and holes 13h and 13h for fitting.

Since this zigzag 13g is engaged with a small projection (not shown) formed in the inner side surface of the sliding adjustment sprint 9, delicate adjustment can be easily performed.

Therefore, when the polar contact 1 is to be installed into the electromagnetic device 10, first the relay terminals 19 and 19 are respectively pressed into the grooves 17b and 17b in the holder member 17 to be fixed. Thereafter, the surge absorption element 18 is put into the recesses 17a and 17a of the holder member 17, and at the same time the leading wires 18c and 18c are protrudingly pressed into the notched grooves 19a and 19a.

Then, after the ends 12a and 12b of the coil 12 wound around the trunk of the spool 11 are drawn out along the guide grooves 16a and 16a of the arm portions 16 and 16 to be tied up with the leading wires 18c and 18c of the surge absorption element 18, the coil 12, the surge absorption element 18 and the relay terminal 19 are electrically connected with one another through soldering.

After the movable iron core 2 is inserted through the central hole 11c in the trunk of the spool 11, while the shaft supporting portions 2a and 2b at the opposite ends of the iron core 2 are respectively protrudingly fitted into the holes 3a and 4a, the iron core 2 is fixedly caulked.

Next, the bearing 6 is fitted into and secured to the bearing hole 13c of the bent yoke 13a, so that the operational spring 8 is held between the bent yoke 13a and the bearing 6. On the other hand, the bearing 7 is fitted into and secured to the bearing hole 13c of the plate-like yoke 13b.

It is to be noted here that according to the present embodiment, not only the positioning accuracy of the movable iron core is considerably improved, and the reciprocating movement of the movable iron core 2 is rendered smooth, since the bearings 6 and 7 are fixedly fitted into the beating hole 13c.

Then, an end of the side wall of the bent yoke 13a (the width l2) is passed through between the arm portions 16 and 16 (the maximum opposed distance l1: l2<l1). Thereafter, the shaft supporting portion 2a is inserted through the bearing 6, and the other shaft supporting portion 2b is inserted through the bearing 7 fixed to the plate-like yoke 13b. Simultaneously, the projected portions 13f and 13f of the bent yoke 13a are fitted into holes 13h and 13h of the plate-like yoke 13b to be caulked. Thus, the electromagnetic device 10 is completely assembled.

In the movable insulation stand 20, a contacting element 22 having movable points of contact 22a and 22b, and a contact coil spring 23 are included in each of four holder members 21 which are placed in parallel relation to each other with a slit 29 therebetween. In addition, the movable insulation stand 20 has embracing members 24 and 25 which protrude downwards from the opposite side faces. These embracing members 24 and 25 are respectively formed with sliding grooves 24a and 25a which can be slidingly pressed into the opposite side portions of the movable iron piece 3 over the outer frame yoke 13. A small projection (not shown) is provided in the respective inner side surface of the grooves 24a and 25a so as to be engaged with the notched portions 3b and 3b of the iron piece 3. Owing to this small projection, the movabl einsulation stand 20 can be mounted in the electromagnetic device 10 correctly and speedily.

Figure 12:
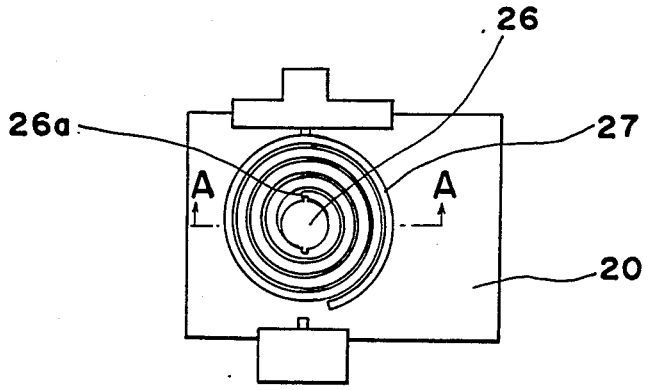
FIGS. 12 and 13 are, respectively, plan views of a coil spring provided in the electromagnetic contactor of FIG. 1.
Figure 13:
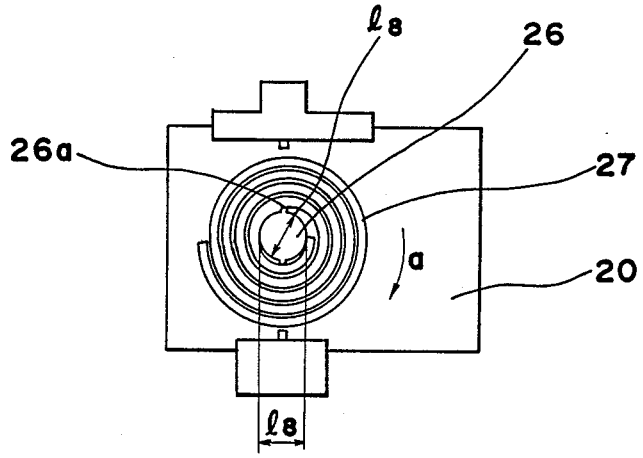
Figure 14:
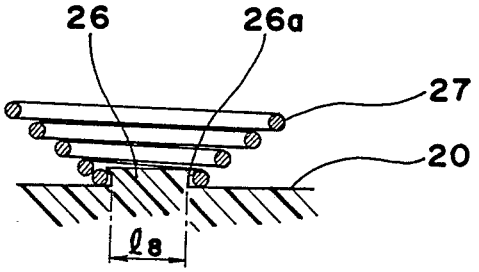
FIG. 14 is a cross-sectional view taken along the line A—A of FIG. 12.

The movable insulation stand 20 has, as shown in detailed manner in FIGS. 12 to 14, a projection 26 formed at the central part on the lower surface in the Y direction. The projection has approximately the same diameter (l8) as the inner diameter of a conical coiled spring 27 at the side of smaller diameter, and the same height as the diameter of a spring wire. The projection 26 is formed with a pair of opposing engagement portions 26a and 26a at the front end thereof.

The conical coil spring 27 is mounted in the projection 26 in the manner as shown in FIGS. 12 and 14.

Specifically, the coil spring 27 may be mounted directly in the state as shown in FIG. 12 by pressing the side of the smaller diameter to engage the inner surface of the spring with the engaging portion 26a, or it may be mounted in the state of FIG. 12 after it is rotated about 90° in the direction of an arrow a as shown in FIG. 13.

The thus-mounted coil spring 27 never slips off from the movable insulation stand 20, even in the case that the movable insulation stand with the coil spring 27 mounted therein is turned sideways or upside down. Since the projection 26a has the same height as the diameter of the coil, the coiled spring 27 can be rendered expansible with much room, which fact is nevertheless not an obstacle to the mountings.

When the movable insulation stand 20 is to be installed in the electromagnetic device 10, the sliding grooves 24a and 25a are positioned with respect to the movable iron piece 3 from the lateral direction of the electromagnetic device 10. Thereafter, the small projections (not shown) of the sliding grooves 24a and 25a are pushed until they are engaged with the notches 3b and 3b, thus making one unit. At this time, since there is a fear that the lower end of the conical coils spring 27 in the Y direction should be engaged with the shaft supporting portion 2a protruding out of the outer frame yoke 13, the movable insulation stand 20 had better be pressed while the movable iron core 2 is moved a little in the Y direction.

Subsequently, after the sliding adjustment spring 9 is slidingly pressed into the opposite ends of the plate-like yoke 13b in the longitudinal direction, the inner components are completely assembled. Side casings 30 and 31 have the configuration symmetrical when their respective openings are overlapped. A projection 30a for positioning is designed to be fitted in a recess 30b for positioning. Further, an engaging claw 32a and an engaging recess 32b provided respectively in the upper end part 30c of the casing 30 are designed to be engaged with each other. When the projection 30a is fitted in the recess 30b and the engaging claw 32a is engaged with the recess 32b, and both are integrally formed into one unit, the side casings 30 and 31 make a box-like configuration, with a mouth at the side of the Y direction. On the other hand, at the side of the Y′ direction of the casing, a terminal receiving room 34 is formed which is divided one from another by an insulative wall 33 orthogonal to the upper end part 30c.

A fixed terminal 35 secured to fixed points of contact 35a and 35b and a coiled terminal 36 are arranged to be passed into this terminal receiving room 34 along a lateral groove 33a formed in the insulative wall 33 so as to be fixed by screw terminals 37 and 37. It is needless to say that the screw terminals 37 and 37 can be electrically connected to an external leading terminal (not shown).

Each of the side casings 30 and 31 is further provided with a pair of walls 38a and 38b parallelly projected on the inner bottom surface. The distance between the inner side faces of the walls 38a and 38b is equal to the width l3 of the projections 13d and 13d of the bent yoke 13b, and at the same time, equal to the width l4 of the permanent magnets 14 and 14, and the minimum width l5 of the inner plate yokes 15 and 15. Further, the distance between the outer side faces of the walls 38a and 38b is equal to the distance l6 between the inner side faces of the flanges 11a and 11b of the spool 11.

Each of the walls 38a and 38b has a stepped portion 38c (the one wall 38a is not shown) provided at the center of the outer side surface so that the spool 11 is positioned in the direction of the Z-Z′ axis.

In the meantime, a pair of drills 38d and 38d are formed in the inner side faces of the side casings 30a and 31 for positioning the outer frame yoke 13 in the direction of the X-X′ axis. Further, a guide projection 38e is provided there for guiding the outer frame yoke 13.

Therefore, in order to install the electromagnetic device 10 integrally formed with the movable insulation stand 20 into the side casings 30 and 31, first, the outer frame yoke 13 is fixedly positioned by the guide projection 38e formed in the side casing 30. And then, the outer frame yoke 13 is pressed in the Z direction along the drills 38d and 38d, with the projected portion 13d being fitted in between the walls 38a and 38b, and the notched portion 13e being fitted in the wall 38b. Thus, the outer frame yoke 13 is fixedly positioned both in the direction of the X-X′ axis and in the direction of the Y-Y′ axis. Then, the spool 11 is arranged in such a manner that the walls 38a and 38b are held between the inner side faces of the flanges 11*a* and 11*b*, and consequently, the spool 11 is fixedly positioned in the direction of the Y-Y′ axis. At the same time, the side ends of the flanges 11*a* and 11*b* in the Z direction are brought into contact with the stepped portions 38*c*.

Concurrently with this, the coiled terminal 36 which protrudes inwardly of the side casing 30 is pressed in between the tongue elements 19*b* and 19*b* of the relay terminal 19 fixedly pressed in the holder part 17 for electric connection. Moreover, the slit 29 of the movable insulation stand 20 is fitted in the insulative wall 33 protruding inwardly of the side casing 30, so that the movable point of contact 35*a* and the fixed point of contact 22*a* are arranged to be opposite to each other, and likewise, the movable point of contact 35*b* and the fixed point of the contact 22*b* are arranged to be opposed to each other.

Next, along the inner side surface of the outer frame yoke 13, the permanent magnet 14 and the lower end of the inner plate yoke 15 are successively pushed in between the walls 38*a* and 38*b*. Thus, the spool 11 is fixedly positioned in the direction of the X-X′ axis.

At this time, the opposite end faces of the yoke 15 in the direction of the Y-Y′ axis are so opposed, with a predetermined interval, as to be able to be in touch with the inner side faces of the movable iron pieces 3 and 4, respectively.

Thereafter, when the remaining side casing 31 is formed into one unit with the side casing 30 through the engaging claw 32*a*, the engaging recess 32*b*, the projection 30*a* and the recess 30*b*, the spool 11, the outer frame yoke 13, the permanent magnet 14 and the inner plate yoke 15 are all fixedly positioned in the direction of the Z-Z′ axis.

The adjustment spring 9 slidingly pressed into the plate-like yoke 13*b* is exposed from the mouth (not shown) formed when the casings 30 and 31 are formed into one unit, and therefore, if the spring 9 is slid to change the valid distance of the leaf spring 9*a* to be in touch with the end face of the shaft supporting portion 2*b*, the restoring voltage can be adjusted.

In the above-described embodiment, since the side casings 30 and 31 are designed to be separable in the moving direction of the polar contact, the positioning accuracy in the moving direction of the polar contact can be enhanced. Therefore, the contact pressure can be less variable, improving the working characteristics.

A bottom casing 40 having the configuration of a flat plane to cover the mouth (not shown) of the side casings 30 and 31 has an annular projection 41 provided in the upper surface thereof. The annular projection 41 surrounds the above-described mouth formed when the casings 30 and 31 are integrally formed. In addition, the bottom casing 40 is formed with an engaging claw 42 projecting upwards so as to be engaged with an engaging hole 38*f* at the lower part of the side casings 30 and 31. Moreover, there are formed a groove for mounting a rail at the opposite sides in the longitudinal direction of the lower surface of the bottom casing 40 at the side of the Y direction. Rail engaging pieces 46 and 46 are connected to a thin portion 47 in a generally U-shape. At each of the four corners of the bottom casing 40, a hole 44 is formed for mounting the casing onto the surface of the panel plate.

Accordingly, it is enough to mount the casing 40 that the bottom casing 40 is pressed so as engage the engaging claw 42 with the engaging hole 38*f* after the engaging claw 42 is fixedly positioned along the guide grooves 38*g*.

Figure 15:
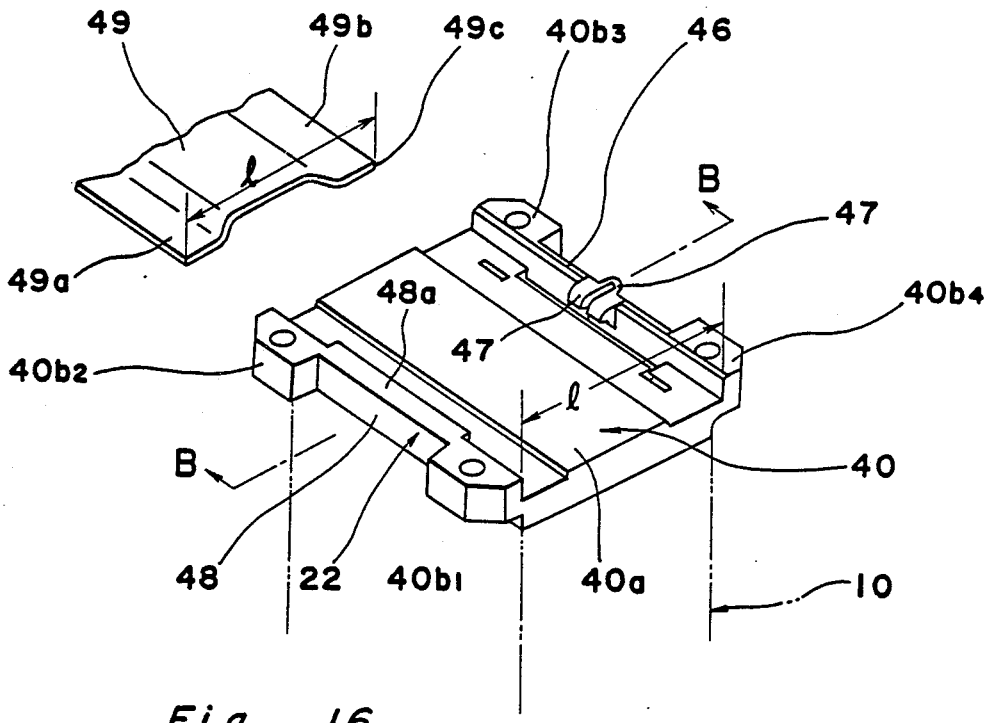
FIG. 15 is a perspective view showing the mounting arrangement of a rail into the electromagnetic contactor of FIG. 1.
Figure 16:
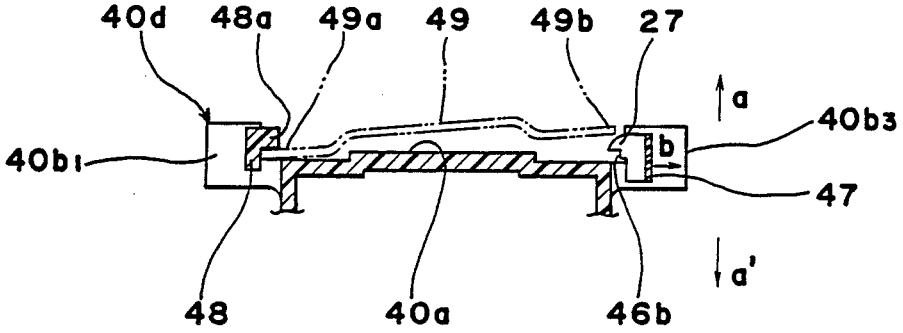
FIG. 16 is a cross-sectional view taken along the line B—B of FIG. 15.

The assemblage of the bottom casing 40 is illustrated in FIGS. 15 and 16 on an enlarged scale.

Referring to FIGS. 15 and 16, the bottom casing 40 of the electromagnetic device 10 is formed with benches 40*b* (40*b*1, 40*b*2, 40*b*3 and 40*b*4) at the four corners of the bottom surface 40*a*. The distance between the bench 40*b*2 and the bench 40*b*3 is made equal to the width l of a rail 49. The benches 40*b*1 and 40*b*2 at one side is provided with a side plate 48 having an engaging portion 48*a* for connecting the benches 40*b*1 and 40*b*2 with each other, forming a guiding part 40*d* as whole.

On the other hand, between the benches 40*b*3 and 40*b*4 at the other side is stretched over an elastic engaging piece 46 parallel to the guiding part 40*d* and along the side face of the guiding part 40*d* of the bench 40*b*3. The elastic engaging means 46 has an engaging claw 46*a* projecting towards the engaging portion 48*a* and a projection 46*b* placed below the engaging claw 46*a*, respectively in pairs, at the central part thereof. The engaging claws 46*a* and 46*a* are connected with each other by a thin coupling means 47 curved in a U-shape, which is provided in back of the claws 46*a* and 46*a*.

The projections 46*a* and 46*b* are, while the electromagnetic device 10 is mounted on the rail 49, brought into pressed contact with an end 49*c* of the rail 49, and designed to hold, together with the bench 40*b*1 and the side plate 48, the opposite ends of the rail 49.

The outer surface of the engaging claw 46*a* is a curved surface. As shown in FIG. 16, the electromagnetic device 10 having the rail mounted in the above-described manner has the guiding part 40*d* contacted with one end portion 49*a* of the rail 49 put in a panel or the like (not shown) so as to be engaged with the engaging portion 48*a*. When the engaging claw 46*a* is brought into contact with the other end portion 49*b* of the rail (as shown by a one-dotted line in FIG. 16) and the electromagnetic device 10 is pressed in the direction shown by an arrow a, the outer peripheral surface of the engaging claw 46*a* is slid against the end portion 49*b* of the rail, and accordingly the elastic engaging piece 46 is deflected in the direction shown by an arrow b. As a result, the engaging claw 46*a* is engaged with the end portion 49*b*, and at the same time, the projection 46*b* is pressed in contact against the end surface 49*c* of the rail. Thus, in the manner as described above, the electromagnetic device 10 is mounted on the rail 49.

It is to be noted here that since the engaging claw 46*a* has the curved outer surface, the electromagnetic device 10 can be smoothly mounted on the rail 49.

Moreover, since the elastic engaging piece 46 is coupled, by the U-shaped coupling means 47, at the central part thereof in the b direction, the engaging piece 46 is more ready to be deformed as compared with a plate-like engaging piece. A larger contact pressure can be obtained than in the case without the coupling means. That is, the electromagnetic device 10 is able to be mounted on the rail 49 with an appropriate contact pressure.

In the case the the electromagnetic device 10 is required to be taken off from the rail 49, an edge of a driver or the like is engaged to the coupling means 47 to deflect the elastic engaging piece 46 in the direction of an arrow b, so that the engagement of the engaging claw 47*a* with the end portion 49*b* of the rail is released. And then, the electromagnetic device 10 should be drawn out in the direction shown by an arrow a′.

According to the aforementioned embodiment, the coupling means 47 is made into a U-shape, but is not limited to this and it may be bent into ]-shape.

A terminal protection covering 50 is provided, at the center of the lower surface in the longitudinal direction at the side of the Y direction, with a positioning groove 53 to be fitted with the upper end part 30*c* of the side casings 30 and 31. Moreover, a row of terminal protectors 52 is arranged at the opposite sides of the lower surface in the longitudinal direction of the covering 50 in parallel relation to each other. The terminal protectors are separated from each other by a slit 51 and are able to be fitted with the insulative wall 33 of the side casings 30 and 31. There are small semi-spherical projections 54 and 54 at the opposite side ends of the terminal protection covering 50 orthogonal to the X-X' axis, which projections are fitted with fitting grooves 38*h* formed in the inner side surface of the side casings 30 and 31.

Therefore, in assembling, after the positioning groove 53 and the slit 51 are fitted into the upper end part 30*c* and the insulative wall 33 respectively, they should be pressed down from above so that the small projection 54 is fitted into the groove 38*h*.

The operation of the electromagnetic device according to the present embodiment will now be described hereinbelow.

When the coil 12 is not excited, the movable insulative stand 20 is in the returned position in the Y' direction because of the spring force of the conical coil spring 27 and the adjustment spring 9. At the same time, the movable point of contact 22*a* is separated away from the fixed point of contact 35*a*, while the movable point of contact 22*b* is closing the fixed point of contact 35*b*.

Then, when the coil 12 is excited to move the polar contact 1 in the Y direction, the movable insulation stand 20 is displaced in the Y direction through the embracing members 24 and 25. In consequence, the movable point of contact 22*a* closes the fixed point of contact 35*a*, and the movable point of contact 22*b* is opened away from the fixed point of contact 35*b*.

If the excitation of the coil 12 is removed, the movable insulation stand 20 is returned back to the initial state.

In the electromagnetic contactor having the above-described construction, the matching of the suction force characteristics and the load of the electromagnetic device 10 is substantially dependent on the total spring force of the conical coil spring 27 and the operating spring 8. However, if the adjustment spring 9 is slid to change the effective distance of the leaf spring 9*a* which is to be in contact with the end face of the shaft supporting portion 2*b*, the matching can be adjusted.

Figure 17:
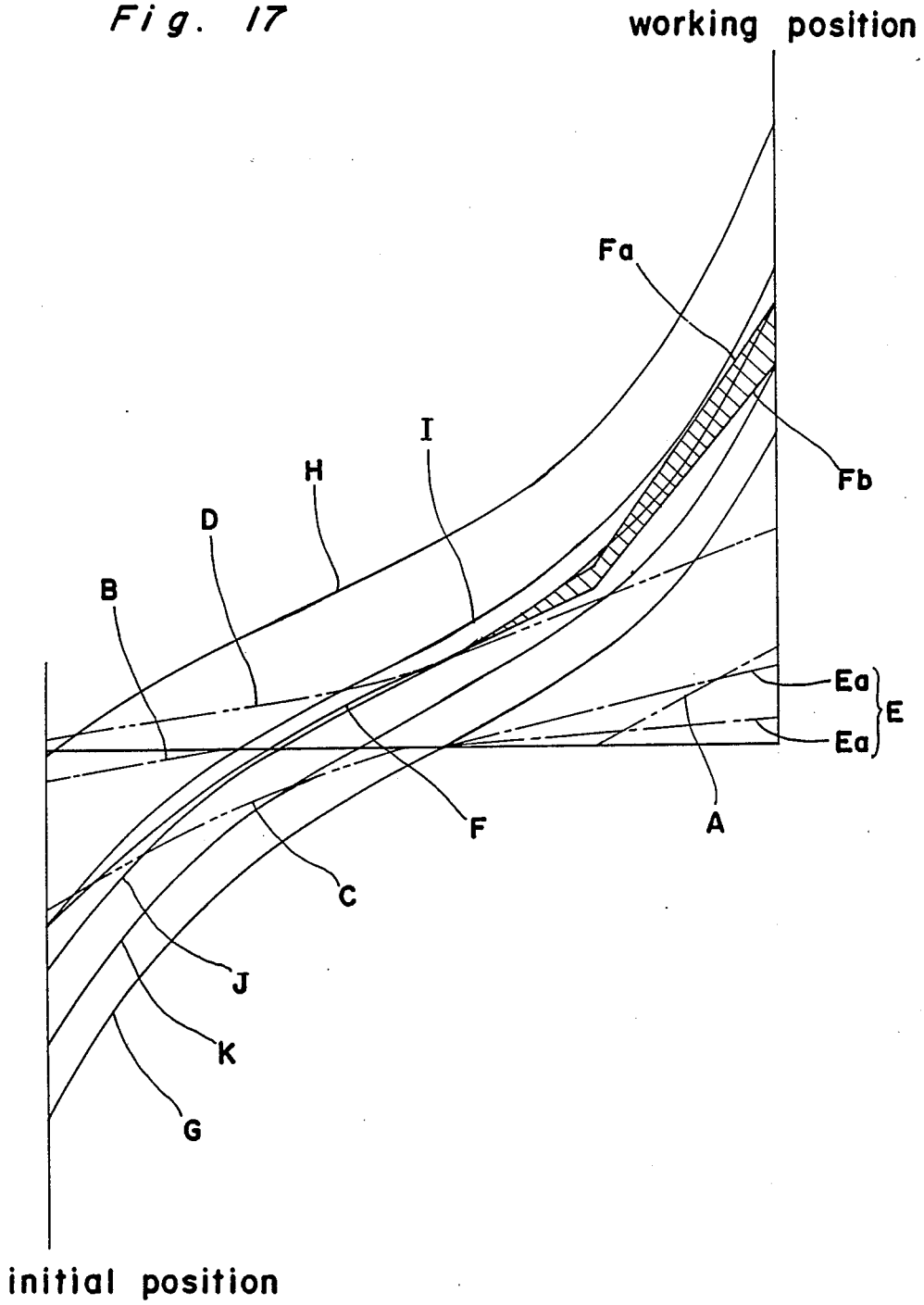
FIG. 17 is a graph showing the working characteristics of the electromagnetic contactor of FIG. 1.

Now, the working characteristics of the electromagnetic contactor of the present embodiment will be observed from the graph of FIG. 17. It is to be noted here that the working direction of the spring force is illustrated in reverse for the sake of easy understanding.

Referring now to FIG. 17, A denotes a contact load of three nromally-opened contacts 35*a*, and B is a contact load of a normally-closed contact 35*b*. C is a spring load of the working spring 8, while D shows a spring load of the conical spring 27. E represents a spring load of the adjustment spring 9, with Ea being the maximum value when the effective length of the leaf spring 9*a* is made small, and Eb being the minimum value when the effective length of the leaf spring 9*a* is made large. F is the total load of all the above-described spring loads. Fa is the total load when E is Ea, while Fb is the load when E is Eb. The total load F is within the range illustrated by oblique lines in FIG. 17. A suction force of the permanent magnets 14 and 14 when the coil is not excited is represented by G, and a suction force when a rated current is applied to the coil is represented by H. Further, I shows a moved ampere turn, namely, a suction force at the operational voltage. J is a suction force at the restoring voltage when the total load F is Fa, while K is a suction force at the restoring voltage when the total load F is Fb.

Although the matching of the suction force characteristics with the load in the electromagnetic device 10 according to the present embodiment is dependent on the spring force of the conical coil spring 27 and the operational spring 8, it can be adjusted if the adjusting spring 9 is slid to change the effective distance of the lead spring 9*a* which is to be in touch with the end face of the shaft supporting portion 2*b*. It is to be noted that the restoring voltage in the present embodiment is adjustable within the range of 20–40% of the rated voltage. By way of example, when the restoring voltage is desired to be controlled in the range of 20–30% of the rated voltage, supposing that the suction force by the permanent magnets 14 and 14 is constant, the total load at the working position is adjustable even when it ranges by the difference of the suction force 10% more or less of the rated voltage.

Meanwhile, the conical coil spring 27 and the working spring 8 are intervened between the electromagnetic device 10 and the movable insulation stand 20, or the electromagnetic device 10 and the polar contact 1, respectively, and thus they are not engaged to and held by housing members such as side casings 30 and 31. In addition, the adjusting spring 9 is slidably mounted in the plate-like yoke 13*b*. In other words, these spring means 27, 8 and 9 are provided independently from the housing members. Therefore, it is advantageous from the viewpoint of positioning accuracy. And, the working characteristics can be inspected and adjusted before assembling the housing members. Furthermore, there are no possibilities that the spring force is changed by the deformation of the housing members after the assembly.

As is clear from the above description of the first embodiment, in accordance with the present invention, since the polar contact and the movable insulation stand are integrally formed into one unit, and the spring member is provided in the electromagnetic device in order to adjust the matching of the suction force characteristics and the load of the electromagnetic device, the spring member can get rid of bad influences from the housing members upon the positioning accuracy and the working characteristics. Moreover, it becomes remarkably easy to detect or adjust the working characteristics because it can be done without the housing members being mounted in the electromagnetic contactor.

Figure 18:
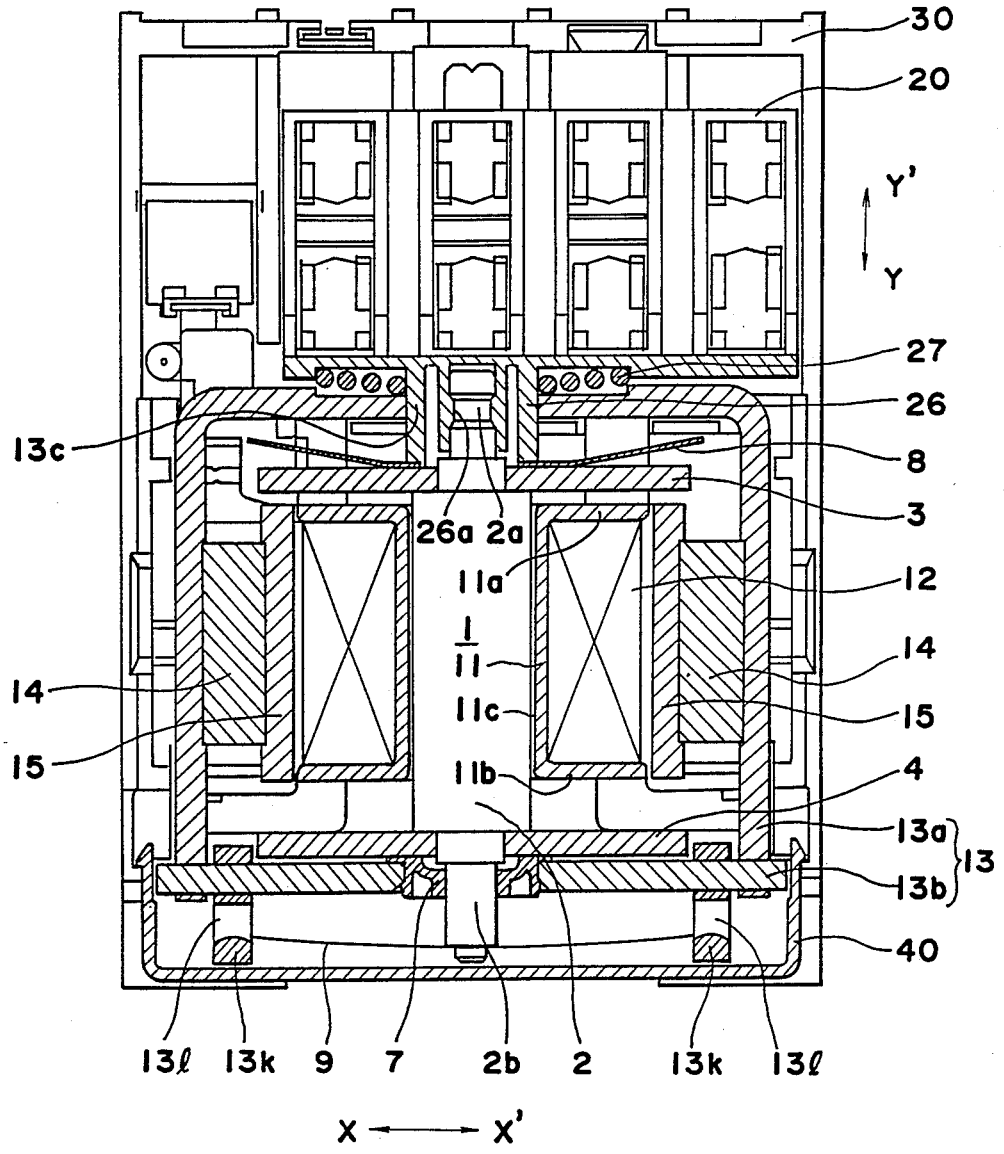
FIG. 18 is a front view, on an enlarged scale, showing an electromagnetic device in a cross-section after removing a front casing, of an electromagnetic contactor according to a second embodiment of the present invention.

An electromagnetic contactor according to a second embodiment of the present invention has approximately the same construction as in the above-described contactor of the first embodiment (referring to FIG. 18), but the difference is in that the end of the shaft supporting portion 2*a* in the polar contact 1 is pressed into the hole 26*a* of the projection 26 formed in the bottom surface of the movable insulation stand 20 to be coupled into one unit according to the second embodiment, while the embracing members 24 and 25 of the movable insulation stand 20 are slidingly pressed into the movable iron piece 3 of the polar contact 1 so as to be coupled into one unit according to the first embodiment.

In the electromagnetic contactor of the second embodiment, the projection 26 is inserted through the bearing hole 13*c* of the outer frame yoke 13, and accordingly, the projection 26 plays the role as a bearing, resulting in reduction of the number of components.

What is further different of the second embodiment from the first embodiment is observed in that the working spring 8 is fixedly held by the outer frame yoke 13 and the bearing 6 according to the first embodiment, while it is fixedly held by the projection 26 and the movable iron piece 3 according to the second embodiment.

Moreover, although the adjusting spring 9 is directly slidingly pressed into the plate-like yoke 13*b* in the first embodiment, the adjusting spring 9 is fixed at its central portion to the end of the shaft supporting portion 2*b* of the polar contact 1, and also at its opposite sides inserted through the holding hole 13*l* of spring holders 13*k* and 13*k* provided with the plate-like yoke 13*b*.

In accordance with the first embodiment, the bottom casing 40 is provided with the annular projection 41 so as to surround the mouth (not shown) formed when the casings 30 and 31 are joined, and with the guide for mounting the rail and the hole 44 for mounting the casing onto the panel surface. On the contrary, according to the second embodiment, both the groove for mounting the rail and the hole for mounting the casing are integrally formed with the side casings 30 and 31. An aperture is formed by coupling the side casings 30 and 31 so as to adjust the adjusting spring 9, which aperture is covered with the detachable cap-like bottom covering 40.

Now, referring to FIGS. 19 to 25, an auxiliary contact system according to a still further embodiment of the present invention will be described hereinbelow.

The auxiliary contact system is utilized, for example, to turn on and off a display means such as a light emitting diode, etc. in accordance with the opening and closing operation of the electromagnetic contactor itself. The auxiliary contact system is generally comprised of an auxiliary casing 60, an auxiliary covering 61, movable contact elements 71 and 76 which have their respective one ends secured to terminals 70 and 75, fixed terminals 65 and 67, and the insulative card 78.

Figure 19:
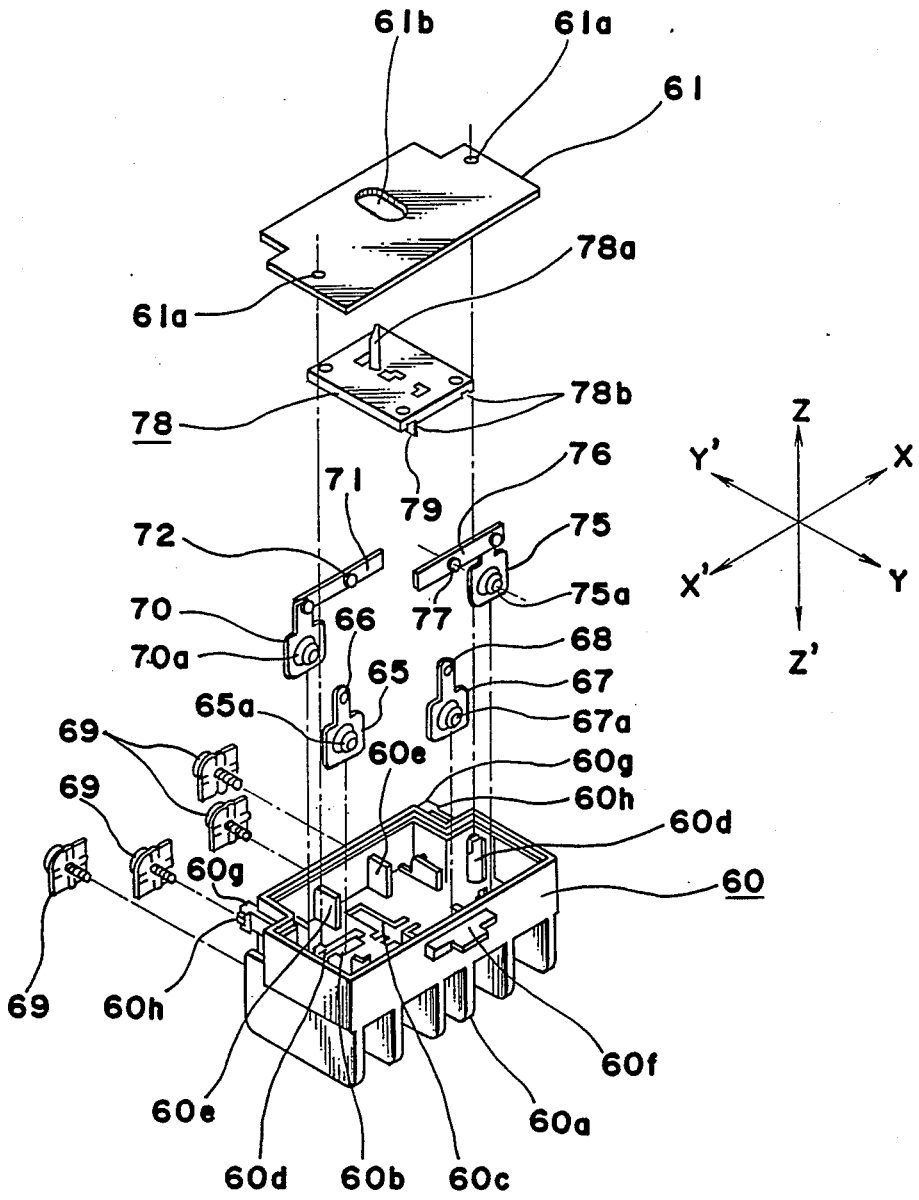
FIG. 19 is an exploded perspective view of an auxiliary contact device installed in an electromagnetic contactor according to a third embodiment of the present invention.

There are a container for the terminals 70, 75, 65 and 67 at the front side of the casing 60 in FIG. 19, and terminal receiving rooms separated from each other by insulative walls 60*a* at the reverse side of the auxiliary casing 60. The terminals 70, 75, 65 and 67 are respectively formed with connecting parts 70*a*, 75*a*, 65*a* and 67*a*. In the upper part of the terminals 65 and 67, there are secured auxiliary fixed points of contact 66 and 68, respectively. Further, there are secured auxiliary movable points of contact 72 and 77 in the middle portion of the movable contact elements 71 and 76 riveted to the terminals 70 and 75. Each of these terminals 70, 75, 65 and 67 is pressed into a hole 60*b* of the casing to be secured thereto, with each of the connecting parts 70*a*, 75*a*, 65*a* and 67*a* protruding to the side of the respective terminal receiving rooms being connected to an external auxiliary circuit by a screw terminal 69.

The insulation card 78 is formed with a projection 78*a* which is engageable to the recess 20*a* of the movable insulation stand 20, and also an auxiliary contact operating mean 79 on the reverse side thereof. When the operating means 79 is placed in the groove 60*c* of the casing 60 and grooved portions 78*b* and 78*b* are engaged with projections 60*e* and 60*e*, the insulation card 78 can be installed in such a manner as to be freely movable in the Y-Y′ direction. The auxiliary covering 61 is fixed to the opening surface of the auxiliary casing 60 through engagement of holes 61*a* and 61*a* with the projections 60*d* and 60*d*, so that the card 78 is prevented from slipping off. At this time, the projection 78*a* of the card 78 protrudes out of the rectangular hole 61*b*.

Figure 20:
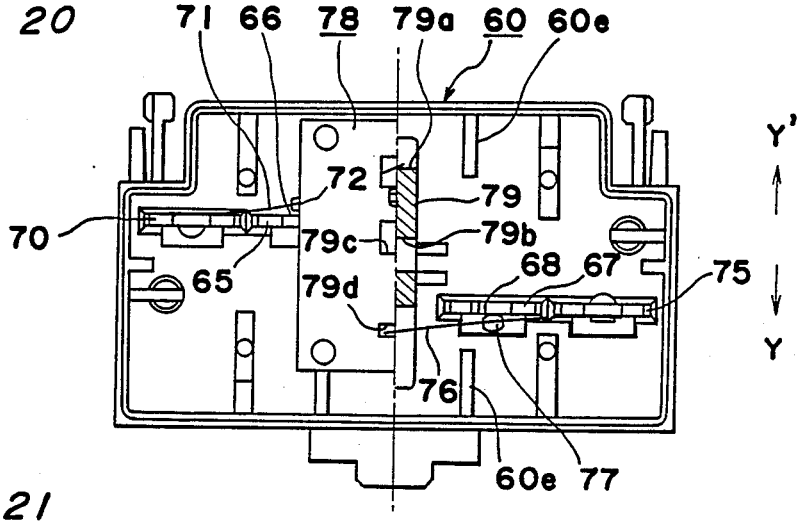
FIGS. 20 to 22 are front views, partially cross-sectioned, respectively showing the state of contact of the auxiliary contact device of FIG. 19.
Figure 21:
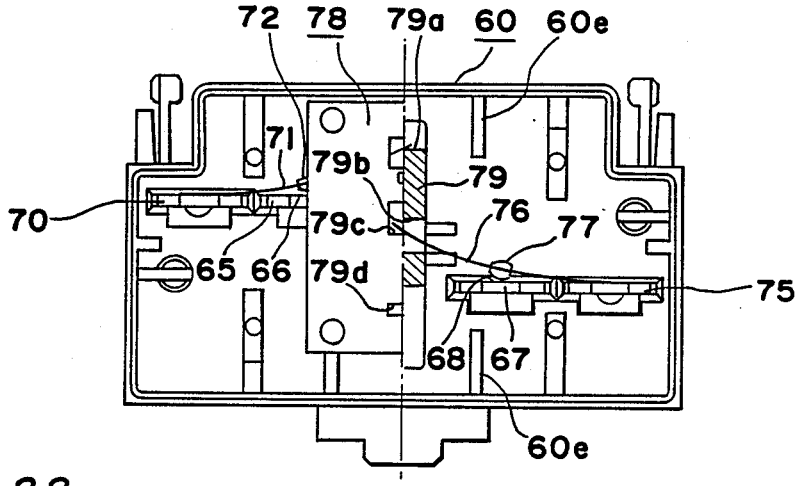
Figure 22:
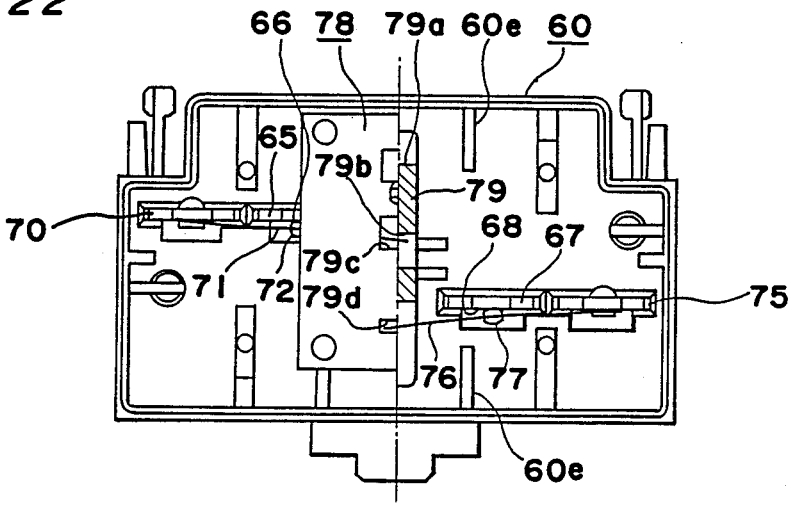

In the assembled state as described above, a free end of each of the movable contact pieces 71 and 76 is, as shown in FIGS. 20 to 22, engaged with one of the notches 79*a*, 79*b*, 79*c* and 79*d* formed in the operating means 79. In other words, in explaining the engagement relation between the contact piece and the notch with reference to their operation, the free end of the movable contact piece 71 is engaged with the notch 79*a*, and the free end of the movable contact piece 76 is engaged with the notch 79*d*, in FIG. 20. When the card 78 is returned in the Y′ direction, the free end of the movable contact piece 71 is urged by the notch 79*a* so as to separate the auxiliary points of contact 66 and 76 from each other, and at the same time, the auxiliary points of contact 68 and 72 are closed by the spring force of the movable contact piece 76 itself. Then, when the card 78 is moved in the Y direction, the auxiliary points of contact 66 and 72 are closed by the spring force of the movable contact piece 71, and the free end of the movable contact piece 76 is urged by the notch 79*d* to separate the auxiliary points of contact 68 and 77 from each other. Namely, the auxiliary points of contact 66 and 72 serve as a normally-opened contact, while the auxiliary points of contact 68 and 77 serves as a normally-closed contact.

Referring to FIG. 21, the free end of the movable contact piece 71 is engaged with the notch 79*a*, and the free end of the movable contact piece 76 is engaged with the notch 79*c*. Therefore, as the card 78 is returned in the Y′ direction, the free end of each of the movable contact pieces 71 and 76 is urged by the notches 79*a* and 79*c*, respectively, whereby the auxiliary points of contact 66 and 72 and, 68 and 77 are separated. When the card 78 is moved in the Y direction, then, the movable contact pieces 71 and 76 follow because of their own spring force. Accordingly, the auxiliary points of contact 66 and 72, and 68 and 77 are connected. In this case, each of these auxiliary points of contact 66, 72, 68 and 77 functions as a normally-opened contact.

In the meantime, in FIG. 22, the free end of each of the movable contact pieces 71 and 76 is engaged with the respective notches 79*b* and 79*d*. Therefore, when the card 78 is returned in the Y′ direction, the auxiliary contacts 66 and 72, and 68 and 77 are closed respectively by the spring force of the contact pieces 71 and 76. When the card 78 is moved in the Y direction, the free ends of the movable contact pieces 71 and 76 are urged by the notches 79*b* and 79*d*, and accordingly the auxiliary points of contact 66 and 72, 68 and 77 are separated away from each other. In this case, each of the auxiliary contacts 66, 72, 68 and 77 works as a normally-closed contact.

Hereinbelow, it will be described how the auxiliary contact system of the above-described structure and operation is mounted in the electromagnetic device 10. The relation of associative operation will also be explained.

With the auxiliary covering 61 being directed to the outer surface of the side casing 31, the projection 78*a* of the card 78 is inserted through the rectangular hole 31*a* into the recess 20*a* of the movable insulation stand 20, and at the same time the projecting piece 60*f* of the auxiliary casing 60 is engaged with the projections 31*b* and 31*b*, and the projected portions 60*h* and 60*h* forced in the arm portions 60*g* and 60*g* are respectively engaged to the holes 31*c* and 31*c*. Thus, the auxiliary casing 60 is fixed to the side casing 31, and the insulation stand 78 is integrally formed with the movable insulation stand 20, thereby to be able to reciprocate in the Y-Y' direction. It is to be noted here that when the auxiliary casing 60 is to be removed, the arm portions 60*g* and 60*g* should be knocked inside to release the engagement with the holes 31*c* and 31*c* of the side casing 31.

Meanwhile, in the auxiliary contact system according to the present invention, when the coil 12 is excited and the movable insulation stand 20 is in the returned position in the Y' direction, the card 78 is also retuned in the Y' direction. On the contrary, when the coil 12 is excited and the movable insulation stand 20 is moved in the Y direction, whereby the auxiliary contacts 66, 72, 68 and 77 are opened or closed.

Figure 23:
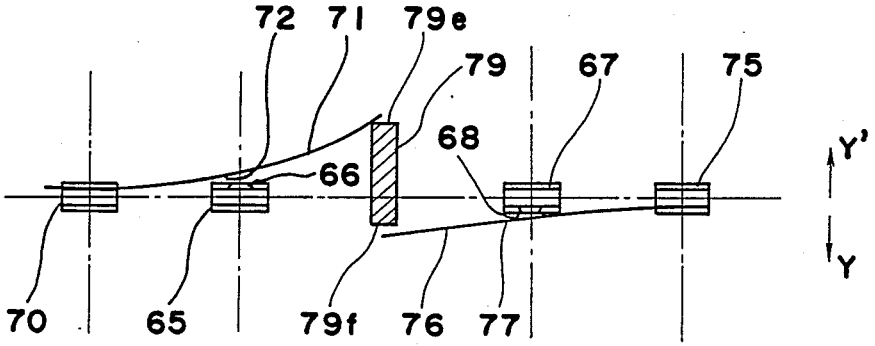
FIGS. 23 to 25 are diagrammatic views each showing the state of contact of an auxiliary contact device according to the other embodiments of the present invention.
Figure 24:
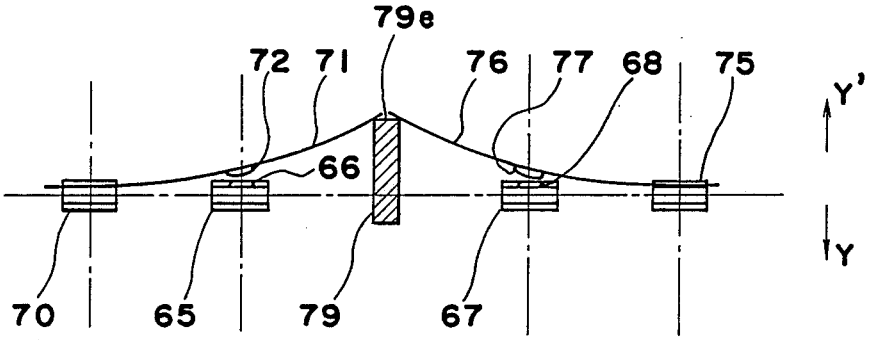
Figure 25:
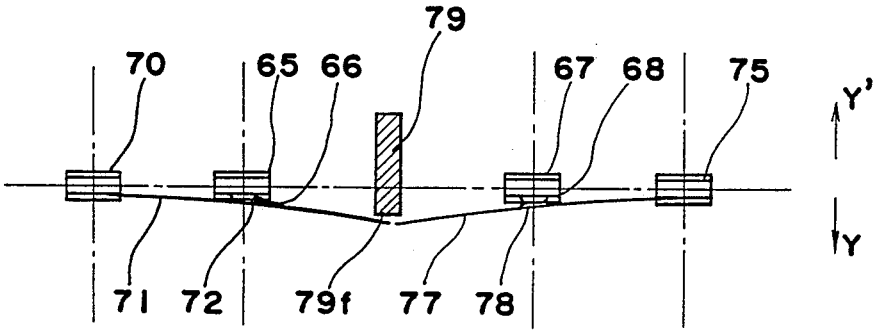

In accordance with the above embodiment, a pair of right and left contact systems are placed at an offset position with a big difference. The reason for this is that the movable contact pieces 71 and 76 can be applied with less stress if they are made as long as possible since the pitch between the terminals 65 and 70, and 67 and 75 is small. However, if the pitch between the terminals can be made large enough, it is not necessary to place the contact systems at an offset relation. As shown in FIGS. 23 to 25, the terminals 65, 70, 67 and 75 may be arranged on a straight line. In FIG. 23, the free end of the movable contact piece 71 is engaged with the end portion 79*e* of the operating member 79, with the free end of the movable contact piece 76 being engaged with the end portion 79*f* of the operating member 79. The auxiliary points of contact 66 and 72 function as normally-opened contacts, while the auxiliary points of contact 68 and 77 function as normally-closed contacts.

Referring to FIG. 24, the free end of each of the movable contact pieces 71 and 76 is engaged with the end portion 79*e* of the operating member 79. The auxiliary points of contact 66, 72, 68 and 77 work as normally-closed contacts. Moreover, in FIG. 25, the free end of each of the movable contact pieces 71 and 76 is engaged with the end portion 79*f* of the operating member 79. Therefore, the auxiliary points of contact 66, 72, 68 and 77 function as normally-closed contacts.

As is clear from the foregoing description, according to the third embodiment of the present invention, a free end of the movable contact piece is engaged to a card integrally formed with the movable insulation stand of the electromagnetic contactor. Accordingly, as the card reciprocates, the movable contact piece swings so that the auxiliary movable contact secured to the middle of the movable contact piece is contacted with or separated from the auxiliary fixed point of contact. In other words, the auxiliary contacts are constructed in a manner of a so-called card-lift system. Therefore, the elasticity of the movable contact piece can be made use of to apply contact pressure and also to obtain a high contact pressure. Moreover, even when the contact pressure is high, the contact driving force can be approximately $\frac{3}{4}$ of the contact pressure through utilization of the maximum of the effective spring length of the contact piece, thereby reducing burden of the driving force of the electromagnetic contactor.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An electromagnetic contactor which opens and closes a fixed contact by means of a movable contact provided in a movable insulation stand through a movable polar member to be reciprocating in accordance with excitation and de-magnetization of an electromagnetic device, wherein said electromagnetic device, comprising:

a first yoke member having a generally ]-shaped configuration with a hole at one side;

a second yoke member of a plate-like configuration with guide; a guide opening corresponding to the hole of the first yoke member;

a slidable spring having a leaf spring, wherein the slidable spring slidably fits onto the second yoke to permit delicate adjustment of a movable polar member by sliding the slidable spring relative to the second yoke;

at least a pair of third yoke members installed within a space surrounded by the first and second yoke members;

at least a pair of permanent magnets each inserted between the first yoke member and the third yoke member with placing the same polarity opposite to that of the other;

a cylindrical coil with an opening provided between the pair of third yoke members;

an iron core inserted slidably through the opening of the coil member, the iron core being moved slidingly along the coil member when the coil member is excited;

a pair of iron pieces fixed at both ends of the iron core and positioned against the pair of third yoke members, an embracing member connecting the iron the movable insulation stand provided with the movable contact thereon, and wherein the fixed point of contact being provided at a stationary position facing the movable contact.

2. An electromagnetic contactor as claimed in claim 1, wherein said electromagnetic device and said fixed point of contact are fixedly fitted in a casing which is divided into two portions in the direction of movement of the polar contact.

3. An electromagnetic contactor as claimed in claim 2, wherein said casing consists of a pair of side casings each having the same configuration.

4. An electromagnetic contactor as claimed in claim 1, wherein an adjusting aperture is formed for adjusting means of working characteristics which can be adjusted from outside, said aperture being covered with a detachable covering.

5. An electromagnetic contactor as claimed in claim 3, wherein said casing is divided into two along the direction of reciprocation of said movable iron core, which divided portions of said casings are, when coupled, formed into a box-like configuration.

6. An electromagnetic contactor as claimed in claim 5, wherein said casing consists of a pair of side casings each having the same configuration.

7. An electromagnetic contactor as claimed in claim 1, further including a casing for accommodating inner components therein which is divisible into right and left parts, and a bottom casing having a hole for mounting a screw which is fixedly fitted into the outer peripheral portion of the lower part of said casing.

8. An electromagnetic contactor as claimed in claim 7, wherein said casing consists of a pair of side casings each having the same configuration.

9. An electromagnetic contactor as claimed in claim 7, wherein said bottom casing has an annular projection provided on the upper surface thereof so as to surround the outer peripheral portion of the lower part of said casing when said side casings are joined.

10. An electromagnetic contactor as claimed in claim 8, wherein said bottom casing has an annular projection provided on the upper surface thereof so as to surround the outer peripheral portion of the lower part of said casing when said side casings are joined.

11. An electromagnetic contactor as claimed in claim 1, wherein a spring member for applying restoring force to the polar contact and the movable insulation stand is divided into two spring means, the spring force of one of which can be adjusted.

12. An electromagnetic contactor as claimed in claim 1, wherein said polar contact and said movable insulation stand are integrally formed into one unit, and at the same time, said electromagnetic device is provided with a first spring means for urging the electromagnetic device in the operating direction, and a second spring means for urging the electromagnetic device in the returning direction.

13. An electromagnetic contactor as claimed in claim 1, wherein said polar contact and said movable insulation stand are integrally formed into one unit, and at the same time, said electromagnetic device is provided with a spring means which adjusts the matching of suction force characteristics with the load.

14. An electromagnetic contactor as claimed in claim 12, wherein a conical coiled spring is provided between a yoke of the electromagnetic device and the movable insulation stand so as to apply restoring force to the polar contact and the movable insulation stand, while a plate-like working spring is provided between the yoke of the electromagnetic device and a movable iron piece constituting the polar contact so as to apply working force to the polar contact and the movable insulation stand.

15. An electromagnetic contactor as claimed in claim 1, wherein the slidable spring for applying restoring force to said polar contact and said movable insulation stand is divided into two spring materials, one of which is provided with the leaf spring which in turn is slidably mounted in the yoke of the electromagnetic device in the extending direction of the leaf spring so that the leaf spring is brought in contact with the polar contact.

16. An electromagnetic contactor as claimed in claim 1, wherein a matching spring is held between a yoke constituting the electromagnetic device and a bearing which is fittingly pressed into a bearing hole in the yoke and supports one end of said polar contact.

17. An electromagnetic contactor as claimed in claim 1, wherein a projection having an engaging portion at the lateral side thereof is formed at the opposed portion of the movable insulation stand to the yoke, to which projection a coil spring held between the movable insulation stand and the yoke is mounted.

18. An electromagnetic contactor as claimed in claim 1, wherein said movable iron core is reciprocably supported by opposing bearing holes formed in a frame-like yoke surrounding a spool of the electromagnetic device.

19. An electromagnetic contactor as claimed in claim 1, wherein a movable iron piece constituting said polar contact is embraced at opposite sides thereof by embracing means provided at both sides of the movable insulation stand.

20. An electromagnetic contactor as claimed in claim 19, wherein said embracing means is formed with a sliding groove which is slidably pressed into the opposite side portions of said movable iron piece.

21. An electromagnetic contactor as claimed in claim 1, wherein said movable insulation stand and said polar contact are slidably coupled to each other in a direction orthogonal to the moving direction of said polar contact.

22. An electromagnetic contactor as claimed in claim 1, further comprising a coil connecting structure in which a leading wire of a coil wound around a spool surrounded by a yoke is electrically connected to a coil terminal through a relay terminal, said leading wire of the coil drawn out along a pair of arm portions extending over the yoke from an flange of the spool being electrically connected to said relay terminal arranged in a relay terminal holder member.

23. An electromagnetic contactor as claimed in claim 22, wherein said arm portion is formed with a guide groove form guiding said leading wire of the coil.

24. An electromagnetic contactor as claimed in claim 22, wherein said relay terminal holder member is provided with a groove to which is fixedly pressed a relay terminal.

25. An electromagnetic contactor as claimed in claim 23, wherein said relay terminal holder member is provided with a groove to which is fixedly pressed a relay terminal.

26. An electromagnetic contactor as claimed in claim 22, wherein said relay terminal holder member is formed with a recess for accommodating an electric component.

27. An electromagnetic contactor as claimed in claim 23, wherein said relay terminal holder member is formed with a recess for accommodating an electric component.

28. An electromagnetic contactor as claimed in claim 1, further comprising a coil connecting structure in which a leading wire of a coil is electrically connected to a coil terminal through a relay terminal, said leading wire of the coil being tied through soldering to a projection protruding out of said relay terminal.

29. An electromagnetic contactor as claimed in claim 28, wherein said projection is a leading wire of an electric component fixedly pressed into said relay terminal.

30. An electromagnetic contactor as claimed in claim 1, wherein said contactor is detachably mounted in a rail provided on a panel or the like, said rail mounting structure comprising a guide part formed at one side of the bottom surface of said electromagnetic contactor and provided with an engaging portion to be engaged to one side of said rail, and an elastic engaging piece secured with its opposite end portions to the bottom surface at the other side of said electromagnetic contactor with the same distance from the guide part as the rail width and coupled at its central part by a coupling means bent rearwards, said elastic engaging piece being further provided with an engaging claw protruding inwards in the vicinity of said coupling means to be engaged with the other side of said rail.

31. An electromagnetic contactor as claimed in claim 1, wherein a terminal protection covering with a terminal protector is installed in a casing having a plurality of terminal receiving rooms arranged in parallel relation to each other in an exposed condition, and a projection portion is formed either in the inner surface of the outer side of a terminal receiving room at opposite ends of a plurality of terminal receiving rooms or in the side surface of a terminal receiving room opposed to said inner surface of the outer side of the terminal receiving room at opposite ends of a plurality of said terminal receiving rooms, while a recessed portion is formed in the other one of said inner surface of the outer side and said side surface of the terminal receiving room to be engaged with said protecting portion.

32. An electromagnetic contactor as claimed in claim 1, further comprising a coil connecting structure in which a leading wire of a coil is electrically connected to a coil terminal through a relay terminal, with an end portion of said coil terminal which is a contact terminal without a point of contact being pressed into contact with a receiver portion formed in the relay terminal for electric connection.

33. An electromagnetic contactor which opens and closes a fixed contact by means of a movable contact provided in a movable insulation stand to be reciprocating in accordance with excitation and de-magnetization of an electromagnetic device, wherein said electromagnetic device, comprising:

a first yoke member having a generally ]-shaped configuration with a hole at one side;

a second yoke member of a plate-like configuration provided with a guide opening corresponding to the hole of the first yoke member;

at least a pair of third yoke members installed within a space surrounded by the first and second yoke members;

at least a pair of permanent magnets each inserted between the first yoke member and the third yoke member with placing the same polarity opposite to that of the other;

a cylindrical coil with an opening provided between the pair of third yoke members;

an iron core inserted slidably through the opening of the coil member of the first members, the iron piece to the core being moved slidingly along the coil member when the coil member is excited; and a pair of iron pieces fixed at both ends of the iron core and positioned against the pair of third yoke members, and embracing member being the iron piece to the movable insulation stand provided with the movable contact thereon, and wherein the fixed contact being provided at a stationary position facing the movable contact.

34. An electromagnetic contactor which opens and closes a fixed contact by means of a movable contact provided in a movable insulation stand to be reciprocating in accordance with excitation and de-magnetization of an electromagnetic device, wherein said electromagnetic device, comprising:

a first yoke member having a generally ]-shaped configuration with a hole at one side;

a second yoke member of a plate-like configuration provided with a guide opening corresponding to the first yoke member;

at least a pair of third yoke members installed within a space surrounded by the first and second yoke members;

at least a pair of permanent magnets each inserted between the first yoke member and the third yoke member with placing the same polarity opposite to that of the other;

a cylindrical coil with an opening provided between the pair of third yoke members;

an iron core inserted slidably through the opening of the coil member, the iron core being moved slidingly along the coil member when the coil member is excited, wherein a pair of iron pieces fixed at both ends of the iron core and positioned against the pair of third yoke members, and wherein the movable insulation stand is connected to the iron piece by an embracing member to allow the first yoke member to be accommodated between the iron piece and the movable insulation stand.

* * * * *